US007028586B2

(12) United States Patent
Robichaux

(10) Patent No.: US 7,028,586 B2
(45) Date of Patent: Apr. 18, 2006

(54) APPARATUS AND METHOD RELATING TO TONGS, CONTINOUS CIRCULATION AND TO SAFETY SLIPS

(75) Inventor: Dicky Robichaux, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/181,233

(22) PCT Filed: Feb. 26, 2001

(86) PCT No.: PCT/GB01/00781

§ 371 (c)(1),
(2), (4) Date: Jul. 10, 2002

(87) PCT Pub. No.: WO01/66905

PCT Pub. Date: Sep. 13, 2001

(65) Prior Publication Data

US 2003/0075023 A1 Apr. 24, 2003

(30) Foreign Application Priority Data

Feb. 25, 2000 (GB) ..... 0004354.7

(51) Int. Cl.
*B25B 13/50* (2006.01)

(52) U.S. Cl. ..... 81/57.34; 166/90.1; 166/380; 175/215; 175/218

(58) Field of Classification Search ..... 166/77.51, 166/90.1, 379, 380, 80.1, 81.1; 175/215, 175/218, 207; 81/57.34, 57.33, 57.15, 57.16
See application file for complete search history.

(56) References Cited

U.S. PATENT DOCUMENTS 1,150,178 A 8/1915 Deifendorf (Continued)

FOREIGN PATENT DOCUMENTS

DE 2 128 362 1/1972

(Continued)

OTHER PUBLICATIONS

International Search Report, International Application No. PCT/GB 01/00781, dated Sep. 27, 2001.

(Continued)

*Primary Examiner*—Debra S Meislin
(74) *Attorney, Agent, or Firm*—Patterson & Sheridan

(57) ABSTRACT

A tong system includes an upper tong having grips for gripping a tubular and a rotation mechanism to rotate the grips and the tubular. A lower tong also has grips and a rotation mechanism to rotate the grips to provide rotation to a lower tubular, such that the upper and lower tubulars may be made up/broken out from one another, also so that string of tubulars may be rotated for drilling purposes without requiring a rotary table. Also, an apparatus and method for circulating fluid through a tubular string has a first fluid conduit for supplying fluid to the bore of an upper tubular to be made up into or broken out from the tubular string and a second fluid conduit for supplying fluid to the bore of the tubular string, which allows continuous circulation of fluid to occur whilst running the string into/pulling the string from, a borehole and also whilst making up tubulars into/breaking out tubulars from the string. Also, an upper seal for sealing about a portion of the outer circumference of a tubular to be made up onto or broken out from the string and a lower seal means for sealing about a portion of the outer circumference of the string, where the upper seal is an elastomeric ring which has an inner diameter substantially the same as the outer diameter of the tubular. Also, a valve mechanism includes a rotatable plate member and at least one bore. The plate member is moveable between obturation and non-obturation of the tubular. Also, a safety slip to prevent at least one tubular slipping therein has first and second arrangements of grips which are coupled to one another, preferably by a biasing mechanism.

8 Claims, 32 Drawing Sheets

U.S. PATENT DOCUMENTS

| | | | | |
|---|---|---|---|---|
| 1,386,908 | A | 8/1921 | Taylor | |
| 1,842,638 | A | 1/1932 | Wigle | |
| 2,214,194 | A | 9/1940 | Frankley | 251/84 |
| 2,214,429 | A | 9/1940 | Miller | 166/16 |
| 2,522,444 | A | 9/1950 | Grable | 166/16 |
| 2,566,651 | A | 9/1951 | Edelberg | |
| 2,610,690 | A | 9/1952 | Beatty | 166/16 |
| 2,639,894 | A | 9/1953 | Smith | |
| 2,950,639 | A | 8/1960 | Mason | 81/53 |
| 3,021,739 | A | 2/1962 | Grundmann | 81/53 |
| 3,041,901 | A | 7/1962 | Knights | 81/53 |
| 3,086,413 | A | 4/1963 | Mason | 81/53 |
| 3,122,811 | A | 3/1964 | Gilreath | 24/263 |
| 3,131,586 | A | 5/1964 | Wilson | 81/52.4 |
| 3,180,186 | A | 4/1965 | Catland | 81/57 |
| 3,220,245 | A | 11/1965 | Winkle | 73/46 |
| 3,302,496 | A | 2/1967 | Mitchell et al. | 81/53 |
| 3,349,455 | A | 10/1967 | Doherty | 24/263 |
| 3,443,291 | A | 5/1969 | Doherty | 24/263 |
| 3,475,038 | A | 10/1969 | Matherne | 285/27 |
| 3,518,903 | A | 7/1970 | Ham et al. | 81/57.16 |
| 3,559,739 | A | 2/1971 | Hutchison | 166/311 |
| 3,606,664 | A | 9/1971 | Weiner | |
| 3,680,412 | A | 8/1972 | Mayer et al. | 81/57.34 |
| 3,722,331 | A | 3/1973 | Radulescu | 81/52.4 |
| 3,747,675 | A | 7/1973 | Brown | 166/237 |
| 3,796,418 | A | 3/1974 | Carlberg | 269/26 |
| 3,808,916 | A | 5/1974 | Porter et al. | 81/57.19 |
| 3,838,613 | A | 10/1974 | Wilms | 81/57.34 |
| 3,902,385 | A | 9/1975 | Haby | |
| 3,933,108 | A | 1/1976 | Baugh | 114/0.5 D |
| 3,941,348 | A | 3/1976 | Mott | 251/58 |
| 3,986,564 | A | 10/1976 | Bender | 173/4 |
| 4,005,621 | A | 2/1977 | Turner, Jr. et al. | 81/57.2 |
| 4,023,449 | A | 5/1977 | Boyadjieff | |
| 4,142,739 | A | 3/1979 | Billingsley | 285/18 |
| 4,159,637 | A | 7/1979 | Lamb et al. | 73/46 |
| 4,170,908 | A | 10/1979 | Peveto et al. | 81/57.11 |
| 4,202,225 | A | 5/1980 | Sheldon et al. | |
| 4,215,602 | A | 8/1980 | Carstensen et al. | |
| 4,221,269 | A | 9/1980 | Hudson | 173/163 |
| 4,246,809 | A | 1/1981 | Keast et al. | 81/57.16 |
| 4,257,442 | A | 3/1981 | Claycomb | 137/238 |
| 4,262,693 | A | 4/1981 | Giebeler | 137/494 |
| 4,280,380 | A | 7/1981 | Eshghy | |
| 4,291,762 | A | 9/1981 | Gudgel | 166/85 |
| 4,295,527 | A | 10/1981 | Russe | 166/135 |
| 4,315,553 | A | 2/1982 | Stallings | 175/207 |
| 4,334,444 | A | 6/1982 | Carstensen et al. | 81/57.18 |
| 4,346,629 | A | 8/1982 | Kinzbach | 81/57.2 |
| 4,401,000 | A | 8/1983 | Kinzbach | 81/57.2 |
| 4,402,239 | A | 9/1983 | Mooney | 81/57.16 |
| 4,403,666 | A | 9/1983 | Willis | |
| 4,442,892 | A | 4/1984 | Delesandri | 166/85 |
| RE31,699 | E | 10/1984 | Eckel | 73/862.25 |
| 4,492,134 | A | 1/1985 | Reinholdt et al. | 81/57.34 |
| 4,497,224 | A | 2/1985 | Jurgens | |
| 4,499,919 | A | 2/1985 | Forester | 137/613 |
| 4,565,003 | A | 1/1986 | McLeod | 29/281.1 |
| 4,572,036 | A | 2/1986 | Renfro | |
| 4,573,359 | A | 3/1986 | Carstensen | 73/761 |
| 4,592,125 | A | 6/1986 | Skene | |
| 4,593,773 | A | 6/1986 | Skeie | 175/85 |
| 4,643,259 | A | 2/1987 | Zeringue, Jr. | 166/77.5 |
| 4,648,292 | A | 3/1987 | Haynes et al. | |
| 4,649,777 | A | 3/1987 | Buck | 81/57.19 |
| 4,709,766 | A | 12/1987 | Boyadjieff | 175/52 |
| 4,712,284 | A | 12/1987 | Coyle, Sr. et al. | 29/240 |
| 4,715,625 | A | 12/1987 | Shows, Jr. et al. | 285/145 |
| 4,732,373 | A | 3/1988 | Yang | |
| 4,738,145 | A | 4/1988 | Vincent et al. | |
| 4,773,218 | A | 9/1988 | Wakita et al. | 60/476 |
| 4,811,635 | A | 3/1989 | Falgout, Sr. | 81/57.33 |
| 4,821,814 | A | 4/1989 | Willis et al. | |
| 4,869,137 | A | 9/1989 | Slator | |
| 4,895,056 | A | 1/1990 | Schulze-Bechinghausen | |
| 4,938,109 | A | 7/1990 | Torres et al. | 81/467 |
| 4,969,638 | A | 11/1990 | Yang | |
| 4,979,356 | A | 12/1990 | Vatne | 81/57.16 |
| 5,000,065 | A | 3/1991 | Haynes | 81/57.2 |
| 5,022,472 | A | 6/1991 | Bailey et al. | 175/195 |
| 5,044,232 | A | 9/1991 | Schulze-Beckinghausen | 81/57.18 |
| 5,054,550 | A | 10/1991 | Hodge | |
| 5,092,399 | A | 3/1992 | Lang | 166/77.5 |
| RE34,063 | E | 9/1992 | Vincent et al. | |
| 5,150,642 | A | 9/1992 | Moody et al. | 81/57.2 |
| 5,159,860 | A | 11/1992 | Pietras | 81/57.19 |
| 5,161,438 | A | 11/1992 | Pietras | 81/57.16 |
| 5,167,173 | A | 12/1992 | Pietras | 81/57.15 |
| 5,172,613 | A | 12/1992 | Wesch, Jr. | |
| 5,209,302 | A | 5/1993 | Robichaux et al. | 166/355 |
| 5,221,099 | A | 6/1993 | Jansch | 279/151 |
| 5,259,275 | A | 11/1993 | Schulze-Beckinghausen | 81/57.16 |
| 5,297,833 | A | 3/1994 | Willis et al. | 294/102.2 |
| 5,390,568 | A | 2/1995 | Pietras | 81/57.16 |
| 5,451,084 | A | 9/1995 | Jansch | 294/1.1 |
| 5,520,072 | A | 5/1996 | Perry | 81/57.16 |
| 5,634,671 | A | 6/1997 | Watkins | 285/18 |
| 5,667,026 | A | 9/1997 | Lorenz et al. | |
| 5,706,893 | A | 1/1998 | Morgan | 166/86.1 |
| 5,730,471 | A | 3/1998 | Schulze-Beckinghausen et al. | 285/18 |
| 5,746,276 | A | 5/1998 | Stuart | 173/1 |
| 5,787,982 | A | 8/1998 | Bakke | 166/242.6 |
| 5,819,605 | A | 10/1998 | Buck et al. | 81/57.33 |
| 5,839,330 | A | 11/1998 | Stokka | 81/57.33 |
| 5,842,390 | A | 12/1998 | Bouligny et al. | 81/57.34 |
| 5,845,549 | A | 12/1998 | Bouligny | 81/57.33 |
| 5,890,549 | A | 4/1999 | Sprehe | 175/71 |
| 5,992,801 | A | 11/1999 | Torres | 248/49 |
| 5,996,444 | A | 12/1999 | Pearce et al. | |
| 6,047,775 | A | 4/2000 | Mock | |
| 6,065,372 | A | 5/2000 | Rauch | 81/57.15 |
| 6,082,224 | A | 7/2000 | McDaniels et al. | 81/57.15 |
| 6,082,225 | A | 7/2000 | Richardson | 81/57.16 |
| 6,116,118 | A | 9/2000 | Wesch, Jr. | |
| 6,119,772 | A | 9/2000 | Pruet | 166/81.1 |
| 6,138,529 | A | 10/2000 | Pietras | 81/57.33 |
| 6,142,041 | A | 11/2000 | Buck | |
| 6,161,617 | A | 12/2000 | Gjedebo | 166/77.52 |
| 6,206,096 | B1 | 3/2001 | Belik | 166/77.51 |
| 6,223,629 | B1 | 5/2001 | Bangert | 81/57.15 |
| 6,253,845 | B1 | 7/2001 | Belik | |
| 6,276,238 | B1 | 8/2001 | Junck et al. | |
| 6,305,720 | B1 | 10/2001 | Spiering et al. | 285/18 |
| 6,315,051 | B1 * | 11/2001 | Ayling | 166/380 |
| 6,327,938 | B1 | 12/2001 | Pietras | 81/57.33 |
| 6,330,911 | B1 | 12/2001 | Allen et al. | 166/77.51 |
| 6,360,633 | B1 | 3/2002 | Pietras | 81/57.34 |
| 6,374,706 | B1 | 4/2002 | Newman | |
| 6,412,554 | B1 | 7/2002 | Allen et al. | 166/80.1 |
| 6,480,811 | B1 | 11/2002 | Denny et al. | 702/188 |
| 2002/0157823 | A1 | 10/2002 | Schulze-Bechinghausen | |
| 2004/0237726 | A1 | 12/2004 | Schulze-Beckinghausen | |

FOREIGN PATENT DOCUMENTS

| | | |
|---|---|---|
| DE | 3 523 221 | 2/1987 |
| EP | 0 087 373 | 8/1983 |
| EP | 0 285 386 | 5/1988 |
| EP | 0 285 386 | 10/1988 |
| EP | 0 311 455 | 4/1989 |

| | | |
|---|---|---|
| EP | 0 339 005 | 10/1989 |
| EP | 0 311 455 | 12/1989 |
| EP | 0 423 055 | 4/1991 |
| EP | 0 525 247 | 2/1993 |
| EP | 0 525 247 | 3/1993 |
| GB | 804798 | 11/1958 |
| GB | 1 215 967 | 12/1970 |
| GB | 2 049 518 | 12/1980 |
| GB | 2 115 940 | 9/1983 |
| GB | 2 128 526 | 5/1984 |
| GB | 2 300 896 A | 11/1996 |
| GB | 2 346 576 | 8/2000 |
| GB | 2 346 577 | 8/2000 |
| GB | 2 352 667 | 2/2001 |
| WO | WO 83/03443 | 10/1983 |
| WO | WO 92/18744 | 10/1992 |
| WO | WO 93/18276 | 9/1993 |
| WO | WO 95/20471 | 8/1995 |
| WO | WO 98/16716 | 4/1998 |
| WO | WO 98/32948 | 7/1998 |
| WO | WO 99/34089 | 7/1999 |
| WO | WO 99/34090 | 7/1999 |
| WO | WO 99/34091 | 7/1999 |
| WO | WO 00/22278 | 4/2000 |
| WO | WO 00/23686 | 4/2000 |
| WO | WO 00/45026 | 8/2000 |
| WO | WO 00/045027 | 8/2000 |
| WO | WO 00/45027 | 8/2000 |
| WO | WO 00/61906 | 10/2000 |
| WO | WO 00/74899 | 12/2000 |
| WO | WO 00/79092 | 12/2000 |
| WO | WO 01/03889 A1 | 1/2001 |
| WO | WO 01/09479 | 2/2001 |
| WO | WO 01/38688 | 5/2001 |
| WO | WO 01/66905 A2 | 9/2001 |
| WO | WO 01/66905 A3 | 9/2001 |
| WO | WO 01/81047 | 11/2001 |

OTHER PUBLICATIONS

PCT International Search Report dated Jun. 28, 2000 for International Application Serial No. PCT/GB00/01246.

PCT International Preliminary Examination Report from International Application PCT/GB00/04383, dated Feb. 26, 2002.

PCT Search Report, International Application No. PCT/US2004/006753, dated Sep. 8, 2004.

U.K. Search Report, Application No. GB/0422176.8 dated Jan. 5, 2005.

U.S. Appl. No. 10/681,570; Pietras, et al; Oct. 8, 2003; Tong Assembly.

* cited by examiner 200
212
204
214
208
206

212
208
206
214
212
204
202

212
204
202
214
208
210
206

214
208
210
206
200
212
204

APPARATUS AND METHOD RELATING TO TONGS, CONTINOUS CIRCULATION AND TO SAFETY SLIPS

The present invention relates to an apparatus and method of drilling boreholes in the ground or subsea surface, and also to an apparatus and method for use in workovers, well maintenance and well intervention, and particularly, but not exclusively relates to apparatus and method for use in hydrocarbon exploration, exploitation and production, but could also relate to other uses such as water exploration, exploitation and production.

Conventional drilling operations for hydrocarbon exploration, exploitation and production utilise many lengths of individual tubulars which are made up into a string, where the tubulars are connected to one another by means of screw threaded couplings provided at each end. Various operations require strings of different tubulars, such as drill pipe, casing and production tubing.

The individual tubular sections are made up into the required string which is inserted into the ground by a make up/break out unit, where the next tubular to be included in the string is lifted into place just above the make up/break out unit. A first conventional method of doing this uses a single joint elevator system which attaches or clamps onto the outside surface of one tubular section and which then lifts this upwards. A second conventional method for doing this utilises a lift nubbin which comprises a screw thread which engages with the box end of the tubular such as drill pipe, and the lift nubbin and tubular are lifted upwards by a cable. However, this second method in particular can be relatively dangerous since the lift nubbin and tubular will tend to sway uncontrollably as they are being pulled upwards by the cable.

From a second aspect, conventional drilling rigs utilise a make up/break out system to couple/decouple the tubular pipe sections from the tubular string. A conventional make up/break out system comprises a lower set of tongs which are brought together to grip the lower pipe like a vice, and an upper set of tongs which firstly grip and then secondly rotate the upper pipe relative to the lower pipe and hence screw the two pipes together. In addition to this conventional make up/break out system, a conventional drilling rig utilises a rotary unit to provide rotation to the drill string to facilitate drilling of the borehole, where the conventional rotary unit is either a rotary table provided on the drill rig floor or a top drive unit which is located within the drilling rig derrick.

According to a first aspect of the present invention there is provided an apparatus for handling tubulars, the apparatus comprising a pair of substantially vertical tracks;

a rail mechanism movably connected to each track; and a coupling mechanism, associated with the rail mechanism, for coupling to a tubular; and a movement mechanism to provide movement to the rail mechanism.

According to a second aspect of the present invention there is provided a method of handling tubulars, the method comprising:

providing a rail mechanism, the rail mechanism being associated with a coupling mechanism for coupling to a tubular, and the rail mechanism being movably connected to a substantially vertical track;

coupling the coupling mechanism to a tubular; and operating a movement mechanism to move the rail mechanism.

The substantially vertical tracks are preferably secured to a frame which is typically a derrick of a drilling rig. The pair of substantially vertical tracks are preferably arranged about the longitudinal axis of a borehole mouth, such that the pair of tracks and the borehole mouth lie on a common plane, with one track at either side of the borehole mouth.

Preferably, the rail mechanism is suitably connected to the respective track by any suitable means such as runners or rollers and the like. The movement mechanism may comprise a motive means associated with the runners or rollers and the like. Alternatively, the movement mechanism may comprise a cable, winch or the like coupled at one end to the rail mechanism and coupled at the other end to a motor and real arrangement or a suitable counterweight arrangement or a suitable counterbalance winch hoisting or the like.

Preferably, the coupling mechanism comprises a suitable coupling for coupling to the tubular, where the suitable coupling may comprise a member provided with a screw thread thereon for screw threaded engagement with one end of the tubular. Alternatively, the suitable coupling may comprise a vice means to grip the end of the tubular. Alternatively, the suitable coupling may comprise a fluid swivel which couples directly to the end of the tubular, or indirectly to the end of the tubular via a kelly. Typically, the derrick may be provided with a tubular rack for storing tubulars, and a ramp which may extend downwardly at an angle from the lower end of the derrick toward the tubular rack, and a tubular guide track may also be provided at one or both sides of the ramp.

According to a third aspect of the present invention there is provided an apparatus for handling a tubular, the apparatus comprising at least one substantially vertical track;

a coupling mechanism, connected to the track, for coupling to a tubular;

a pair of moveable members which are hingedly connected to both the coupling mechanism and the vertical track, such that movement of the pair of moveable members results in movement of the coupling mechanism substantially about a longitudinal axis of the track.

According to a fourth aspect of the present invention there is provided a method of handling a tubular, the method comprising providing at least one substantially vertical track;

connecting a coupling mechanism to the track, the coupling mechanism for coupling to a tubular;

providing a pair of moveable members which are hingedly connected to both the coupling mechanism and the vertical track; and moving the pair of moveable members to move the coupling mechanism substantially about a longitudinal axis of the track.

Preferably, a rail mechanism is provided and which is movably connected to the track, and typically, the coupling mechanism is associated with the rail mechanism. More preferably, the pair of movable members are hingedly connected to both the coupling mechanism and the rail mechanism.

Preferably, there are a pair of substantially vertical tracks, and the substantially vertical tracks are preferably secured to a frame which is typically a derrick of a drilling rig. The pair of substantially vertical tracks are preferably arranged about the longitudinal axis of a borehole mouth, such that the pair of tracks and the borehole mouth lie on a common plane, with one track at either side of the borehole mouth. Typically, the movement of the pair of movable members results in movement of the coupling mechanism substantially about the longitudinal axis of the track such that a longitudinal axis of a tubular coupled to the coupling mechanism is substantially coincident with the longitudinal axis of the borehole mouth.

Preferably, a motive means is provided to permit movement of the pair of moveable members, where the motive means may be a suitable motor such as a hydraulic motor.

According to a fifth aspect of the present invention, there is provided a tong apparatus, the tong apparatus comprising:

an upper tong having a gripping means for gripping a tubular, the upper tong further comprising a rotation mechanism to provide rotation to the gripping means to provide rotation to said tubular; and a lower tong having a gripping means for gripping a tubular, the lower tong further comprising a rotation mechanism to provide rotation to the gripping means to provide rotation to said tubular.

According to a sixth aspect of the present invention, there is provided a method of providing rotation to at least one tubular, the method comprising:

providing an upper tong having a gripping means for gripping a tubular, the upper tong further comprising a rotation mechanism to provide rotation to the gripping means;

providing a lower tong having a gripping means for gripping a tubular, the lower tong further comprising a rotation mechanism to provide rotation to the gripping means; and operating at least the rotation mechanism of the upper tong to provide rotation to said tubular.

Preferably, the method further comprises operating the rotation mechanism of the lower tong to provide rotation to said tubular.

Typically, the upper tong comprises a plurality of gripping means. Preferably, a range of gripping means can be utilised to grip differing diameters of tubulars.

Preferably, a motive means is provided to actuate the rotation mechanism, where the motive means may be a hydraulic motor having a suitable hydraulic fluid power supply.

Preferably, the lower tong comprises a plurality of gripping means. Preferably, a range of gripping means can be utilised to grip differing diameters of tubulars. Preferably, a motive means is provided to actuate the rotation mechanism, where the motive means may be a hydraulic motor having a suitable hydraulic fluid power supply. Preferably, the lower tong further comprises a turntable bearing means which support ring gear of the gripping means. Typically, the lower tong further comprises a breaking system which permits controlled release of residual tubular string torque.

Preferably, a travelling slip mechanism is also provided and which is capable of engaging at least a portion of the outer circumference of a tubular string, and preferably, the travelling slip is capable of being rotated with respect to the derrick by means of a rotary bearing assembly mechanism. Typically, the travelling slip is provided with a vertical movement mechanism which can be actuated to move the travelling slip and the engaged tubular string in one or both vertical directions.

According to a seventh aspect of the present invention, there is provided an apparatus for circulating fluid through a tubular string, the string comprising at least one tubular, the apparatus comprising:

a first fluid conduit for supplying fluid to the bore of an upper tubular to be made up into or broken out from the tubular string; and a second fluid conduit for supplying fluid to the bore of the tubular string.

According to an eighth aspect of the present invention, there is provided a method of circulating fluid through a tubular string, the string comprising at least one tubular, the method comprising:

providing a first fluid conduit for supplying fluid to the bore of an upper tubular to be made up into or broken out from the tubular string; and providing a second fluid conduit for supplying fluid to the bore of the tubular string.

Preferably, the first fluid conduit is releasably engageable with an upper end of the upper tubular. Preferably, the first fluid conduit is provided with a valve mechanism which can be operated to permit the flow of fluid into or deny the flow of fluid into the first fluid conduit and/or upper end of the tubular.

Preferably, one end of the second fluid conduit is in fluid communication with a chamber, and typically, the second fluid conduit is provided with a valve mechanism which can be operated to permit the flow of fluid into, or deny the flow of fluid into, the second fluid conduit and/or the chamber.

Preferably, the chamber is adapted to permit a tubular to be made up into, or broken out from, a tubular string. The chamber typically comprises a bore, which is preferably arranged to be substantially vertical, and is more preferably arranged to be coincident with the longitudinal axis of the mouth of the borehole. Typically, the chamber comprises an upper port into which the said tubular can be inserted into or removed from the chamber. Preferably, a valve mechanism is provided and is actuable to seal the bore of the chamber, typically at a location below the upper port. Preferably, an upper seal is provided, where the upper seal is preferably located above the said location, and where the upper seal is arranged to seal around at least a portion of the circumference of the said tubular. Typically, a lower seal is provided, where the lower seal is preferably located below the said location, and where the lower seal is arranged to seal around at least a portion of the circumference of the tubular string.

Preferably, a valve system comprising one or more further valves is provided to control the supply of fluid to the first fluid conduit valve mechanism and second fluid conduit mechanism.

Typically, the method comprises the further steps of inserting the lower end of the upper tubular into the upper port, where the valve mechanism typically denies the flow of fluid into the first fluid conduit. At this point, the valve mechanism seals the bore of the chamber. Thereafter, the upper seal seals around at least a portion of the circumference of the tubular, and the valve mechanism of the second fluid conduit is operated to permit the flow of fluid into the chamber, preferably at a location below the valve mechanism sealing the bore of the chamber, such that fluid flows into the upper end of the tubular string.

The method preferably comprises the further steps of operating the valve mechanism to permit the flow of fluid into the first fluid conduit and upper end of the tubular. Preferably, thereafter, the valve mechanism is actuated to open the bore of the chamber, and thereafter, the valve mechanism is operated to deny the flow of fluid into the second fluid conduit. Thereafter, the tubular is preferably made up into the tubular string, and thereafter, the first fluid conduit is typically released from engagement with the upper end of the upper tubular.

According to a ninth aspect of the present invention, there is provided an apparatus for providing a seal between a tubular to be made up in to or broken out from a tubular string, the tubular string comprising at least one tubular, the apparatus comprising:

an upper seal means for sealing about a portion of the outer circumference of the said tubular to be made up onto or broken out from the string;

a lower seal means for sealing about a potion of the outer circumference of the string; and the upper seal comprising an elastomeric ring which is adapted to have an inner diameter substantially the same as the outer diameter of at least a portion of the tubular.

Preferably, the elastomeric ring is formed from a suitable material such as rubber. Typically, the lower seal also comprises an elastomeric ring which is adapted to have an inner diameter substantially the same as the outer diameter of at least a portion of tubular string.

According to a tenth aspect of the present invention there is provided a valve mechanism for use in providing a seal between two tubulars, the valve mechanism comprising:

a plate member which is capable of rotation about an axis;

at least one bore formed through the plate member;

the plate member being arranged such that it is capable of movement between a first configuration in which a portion of the plate member obturates the longitudinal axis of at least one of the tubulars; and a second configuration in which the bore is concentric with the longitudinal axis of at least one of the tubulars.

According to an eleventh aspect of the present invention there is provided a method of providing a seal between two tubulars, the method comprising:

providing a plate member which is capable of rotation about an axis;

the plate member having at least one bore;

wherein the plate member is capable of being rotated between a first configuration in which a portion of the plate member obturates the longitudinal axis of at least one of the tubulars; and a second configuration in which the bore is concentric with the longitudinal axis of at least one of the tubulars.

Preferably, the plate member is capable of being rotated between a first configuration from which a portion of the plate member obturates the longitudinal axis of both of the tubulars, and a second configuration in which the bore is concentric with the longitudinal axis of both of the tubulars, both of the tubulars being concentric with one another.

Preferably, the plate member is arranged within a chamber, such that the radius of the plate member is perpendicular to the longitudinal axis of both tubulars. Preferably, the plate member is substantially circular, and more preferably, the centre axis of the plate member is off-centre with respect to the longitudinal axis of both tubulars.

According to a twelfth aspect of the present invention, there is provided an apparatus to prevent a tubular slipping therein, the apparatus comprising a first arrangement of grips adapted to grip the tubular, and a second arrangement of grips adapted to grip the tubular, characterised in that the first and second arrangements of grips are coupled to one another.

Preferably the first and second arrangements of grips are coupled to one another by a coupling mechanism which is more preferably a biasing mechanism. Preferably the biasing mechanism is arranged to bias the first and second arrangements of grips away from one another. Preferably at least one of or more preferably both of each of the first and second arrangements of grips comprise a first and second portions wherein the first portion is coupled to the second portion by a tapered surface and preferably a moveable locking mechanism, such that the first portion is capable of moving with respect to the second portion along the tapered surface.

Preferably the first arrangements of grips are located vertically below the second arrangements of grips and the first arrangements of grips comprise a relatively large surface area for gripping the tubular and are the primary gripping arrangement.

Typically the second arrangement of grips comprise a relatively smaller surface area for gripping the tubular and provide a backup or safety gripping arrangement.

Preferably a lower face of the second arrangement of grips is coupled to an upper face of the first arrangement of grips and the upper face of the first arrangement of grips is of a larger surface area than a lower face of the first arrangement of grips.

Preferably the first arrangement of grips comprise a stop means for preventing movement of the second arrangement of grips in a direction, preferably radially, away from the tubular being gripped.

Embodiments of the invention will now be described, by way of example only, with reference to the accompanying drawings, in which.

Figure 1:
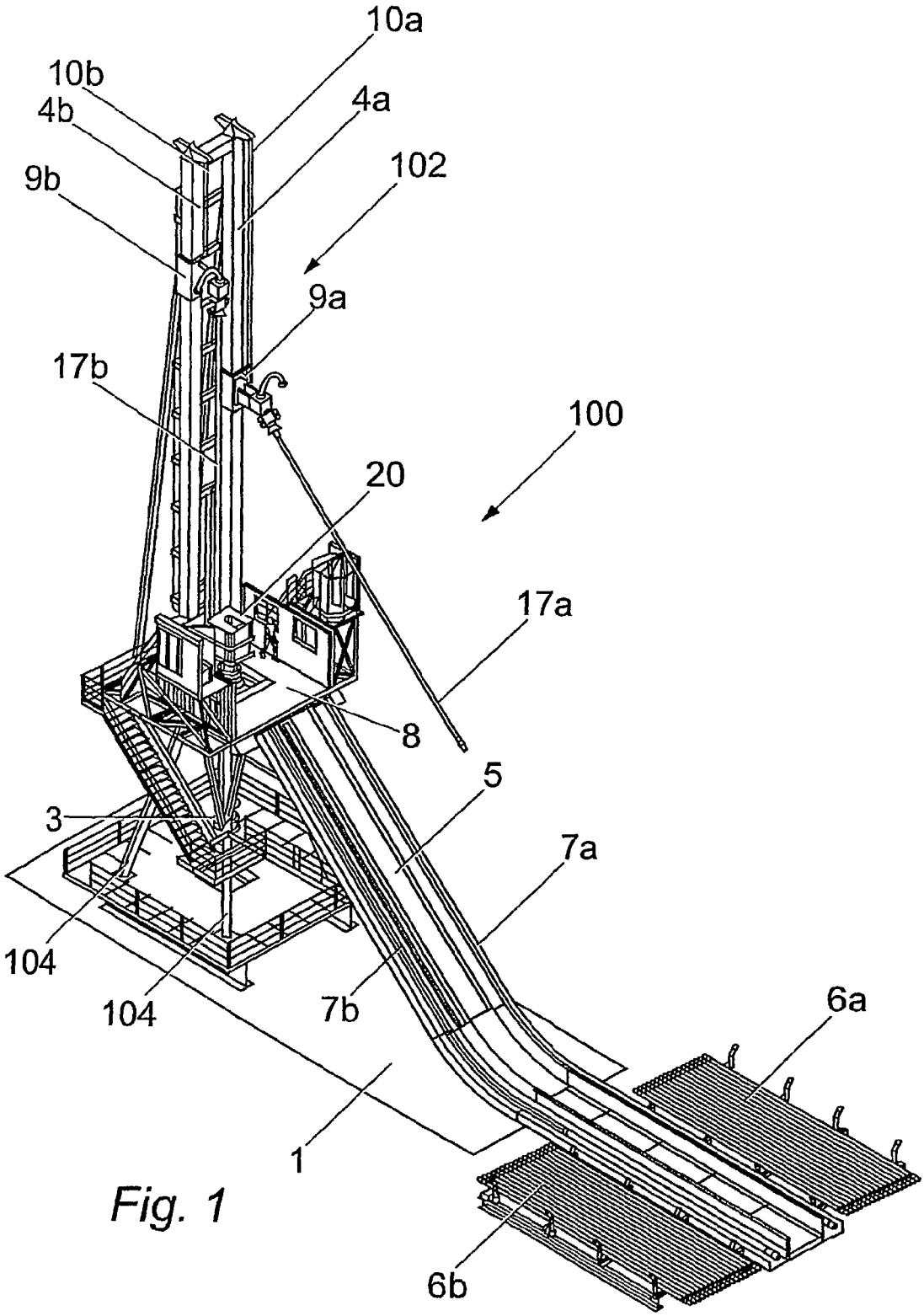
FIG. 1 is a perspective view of a drilling rig incorporating aspects of the present invention.
Figure 2:
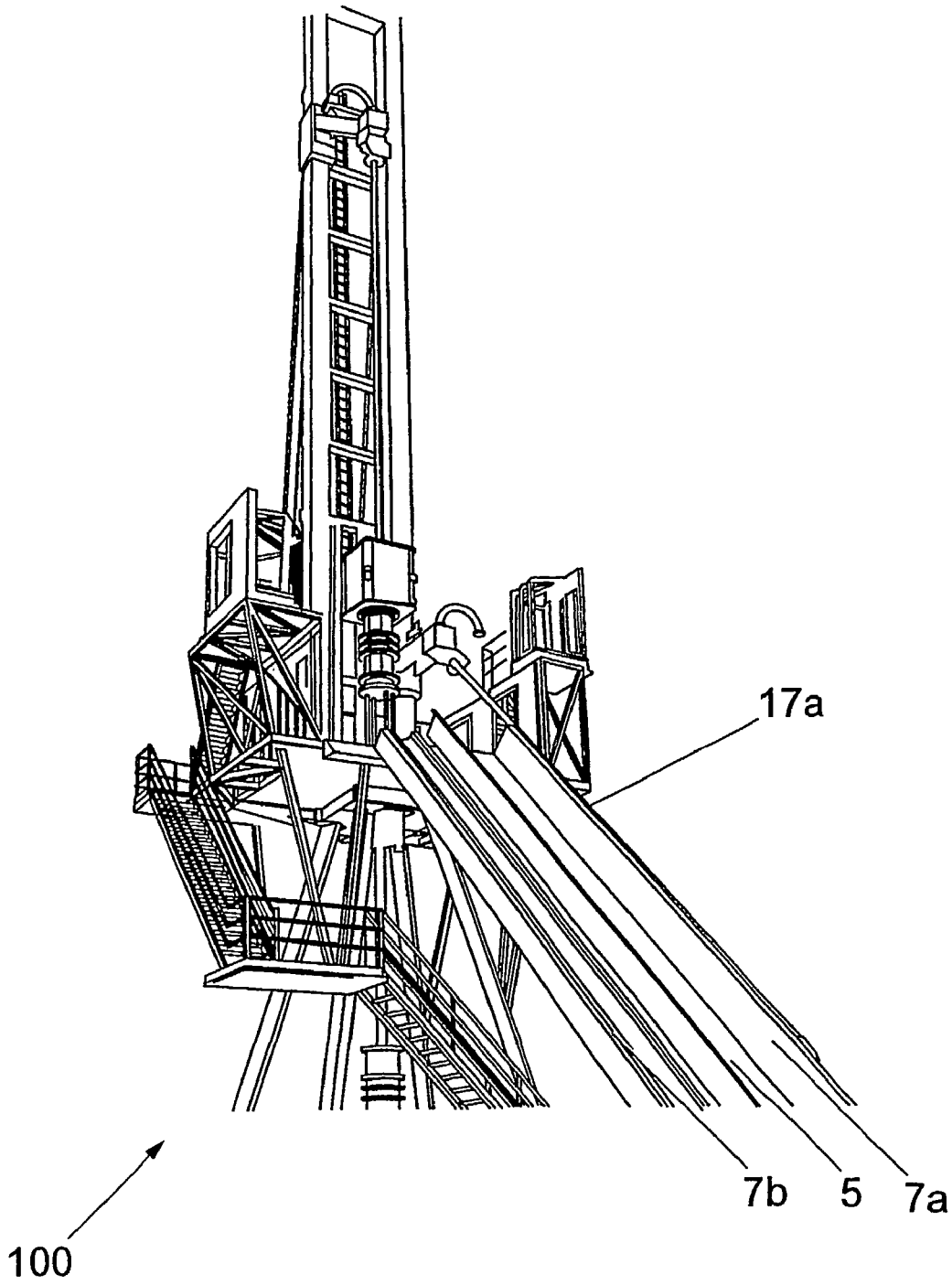
FIG. 2 is a portion of the drilling rig of FIG. 1 in a first configuration.
Figure 3A:
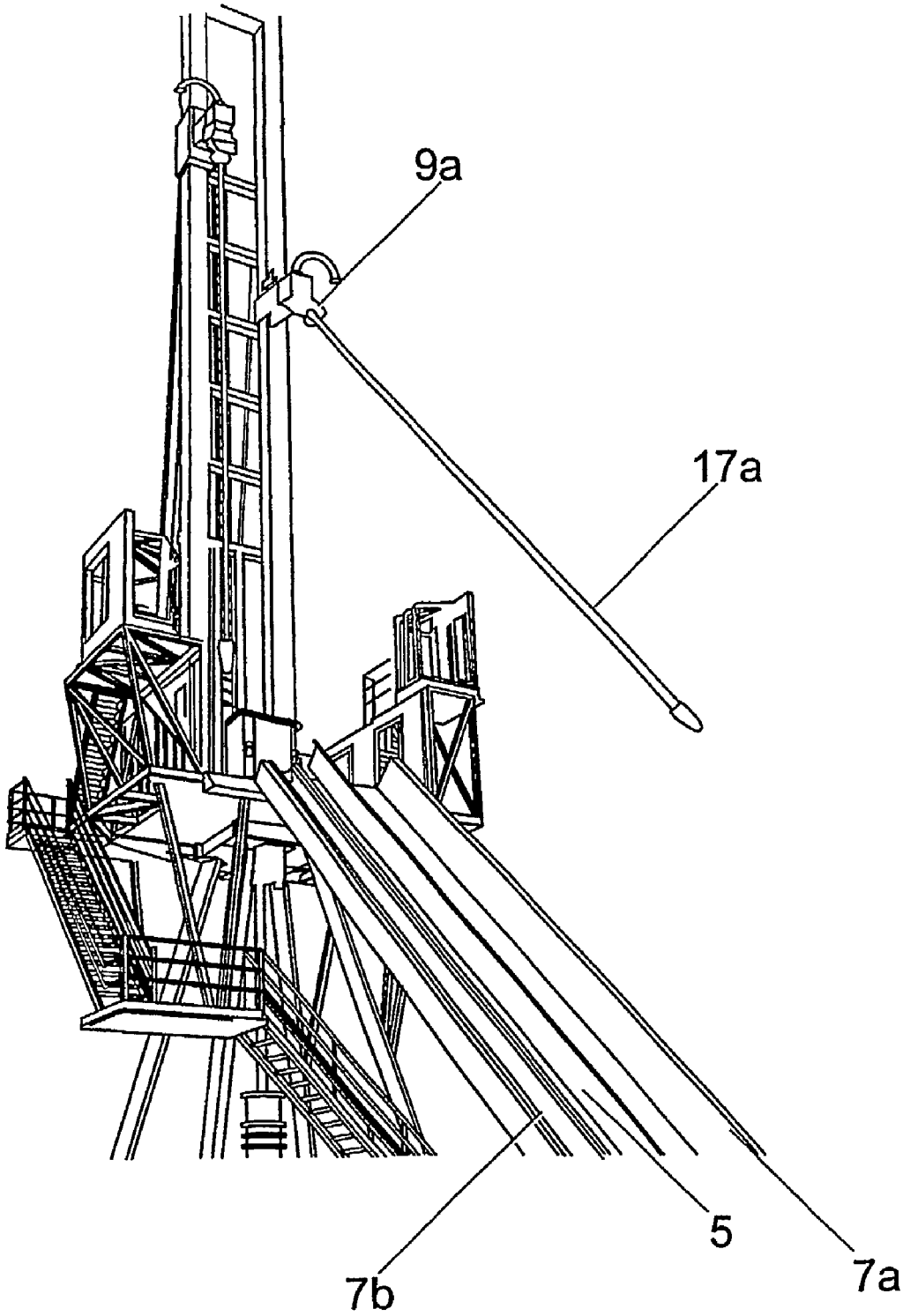
Figure 3B:
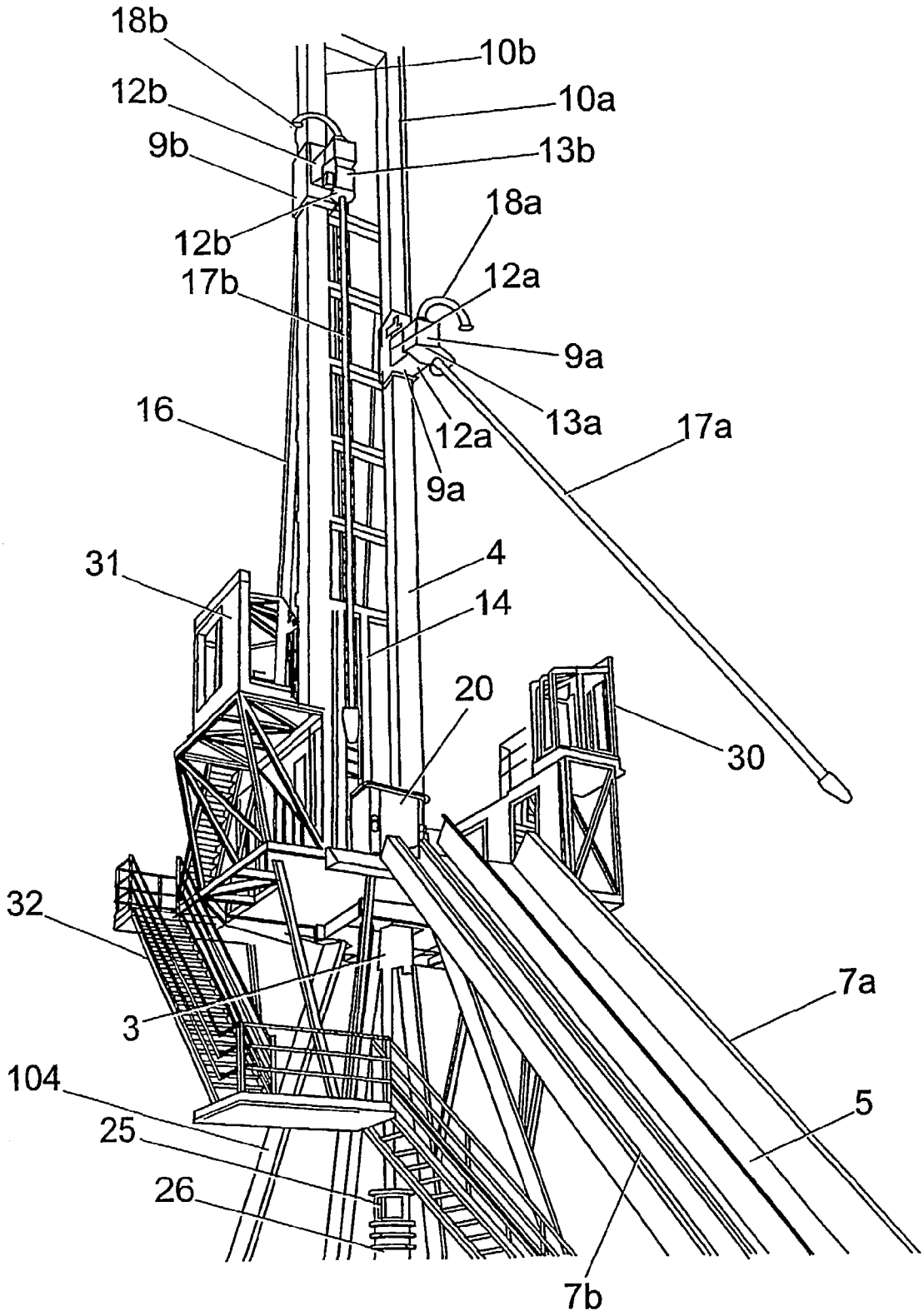

FIG. 3*a* is a portion of the drilling rig of FIG. 1 in a second configuration;

FIG. 3*b* is a more detailed perspective view of the portion of the drilling rig of FIG. 3*a;*

Figure 4:
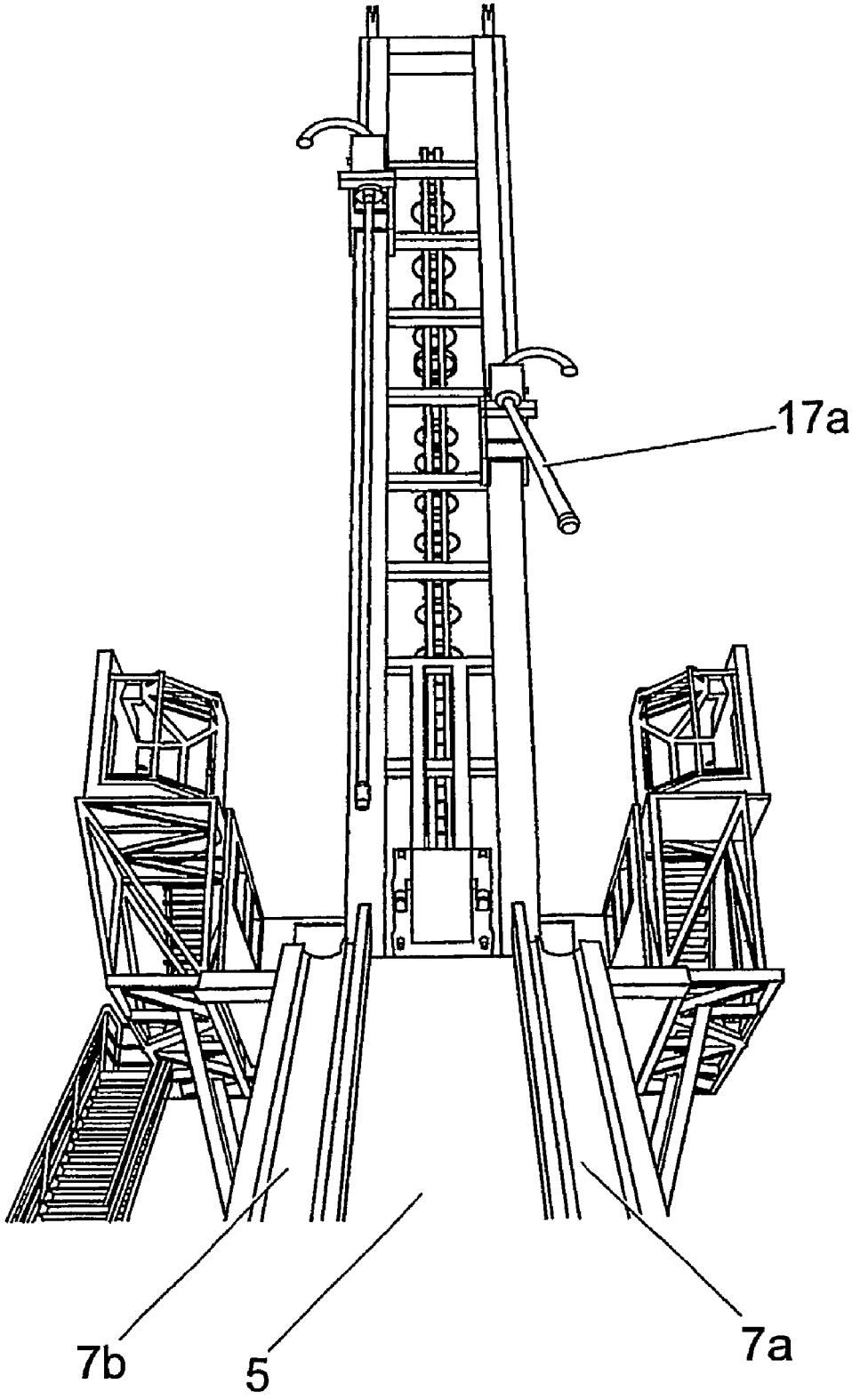

FIG. 4 is a front perspective view of a portion of the drilling rig of FIG. 3*a;*

Figure 5:
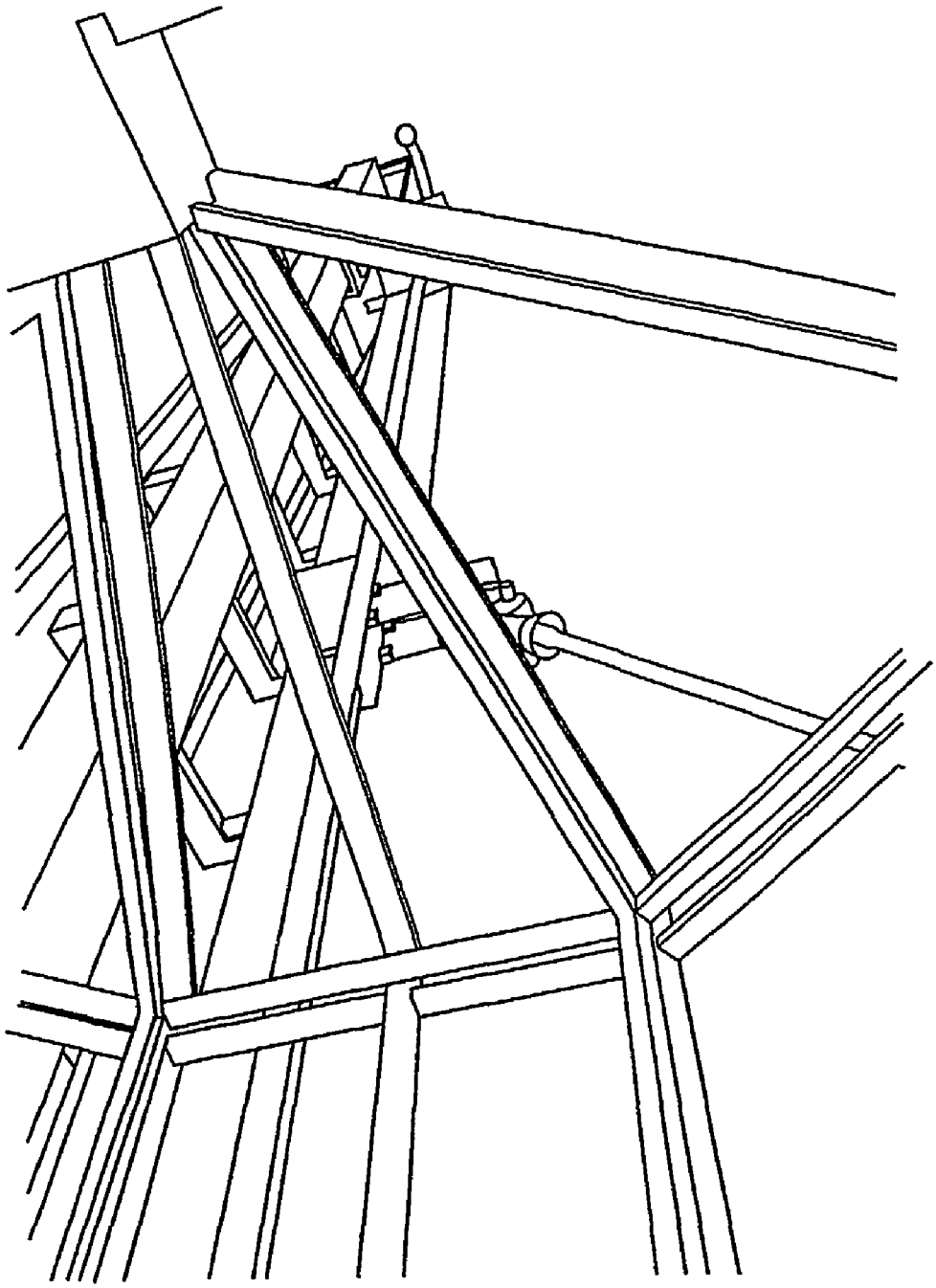

FIG. 5 is a perspective view looking upwardly at the portion of the drilling rig of FIG. 3*a;*

Figure 6:
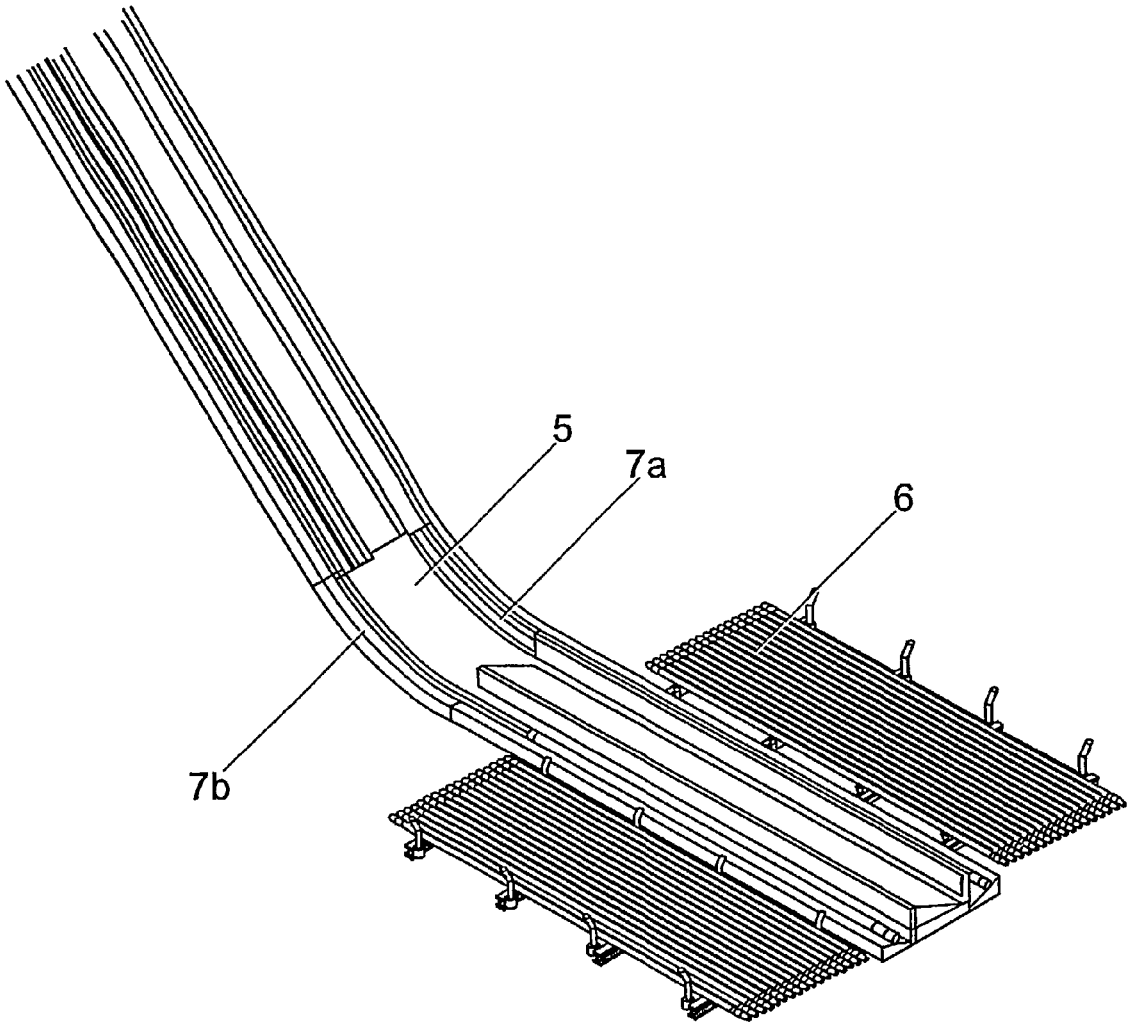
Figure 7A:
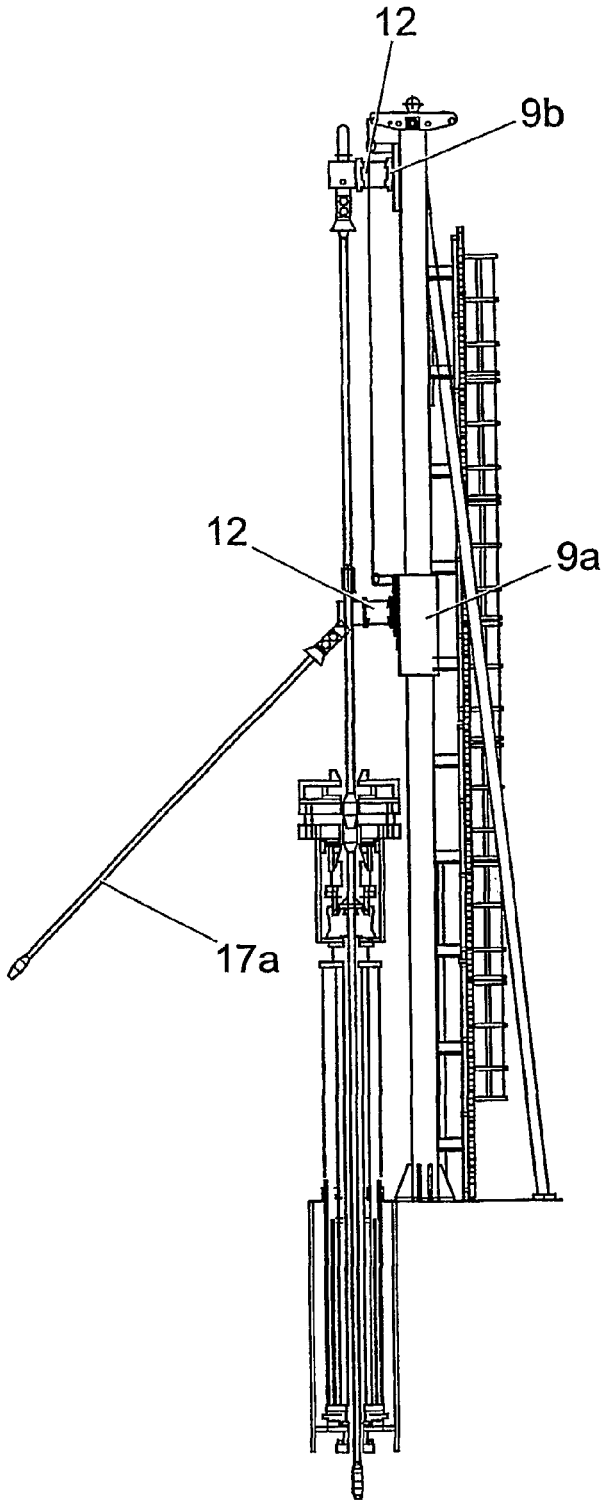
Figure 7B:
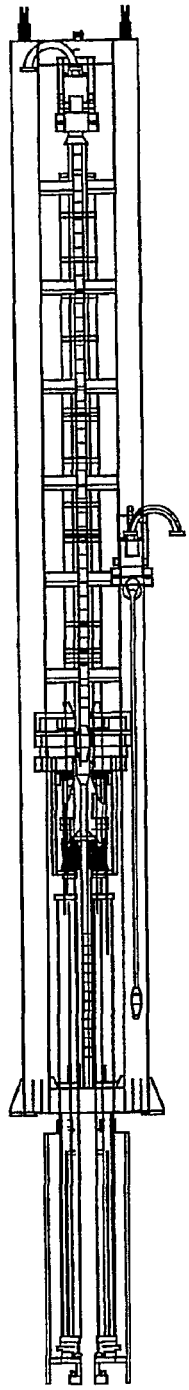

FIG. 6 is a perspective view of a ramp and drill pipe loading area of the drilling rig of FIG. 1;

FIG. 7*a* is a cross-sectional side view of the derrick of the drilling rig of FIG. 1;

FIG. 7*b* is a front view of the derrick of FIG. 7*a;*

Figure 8A:
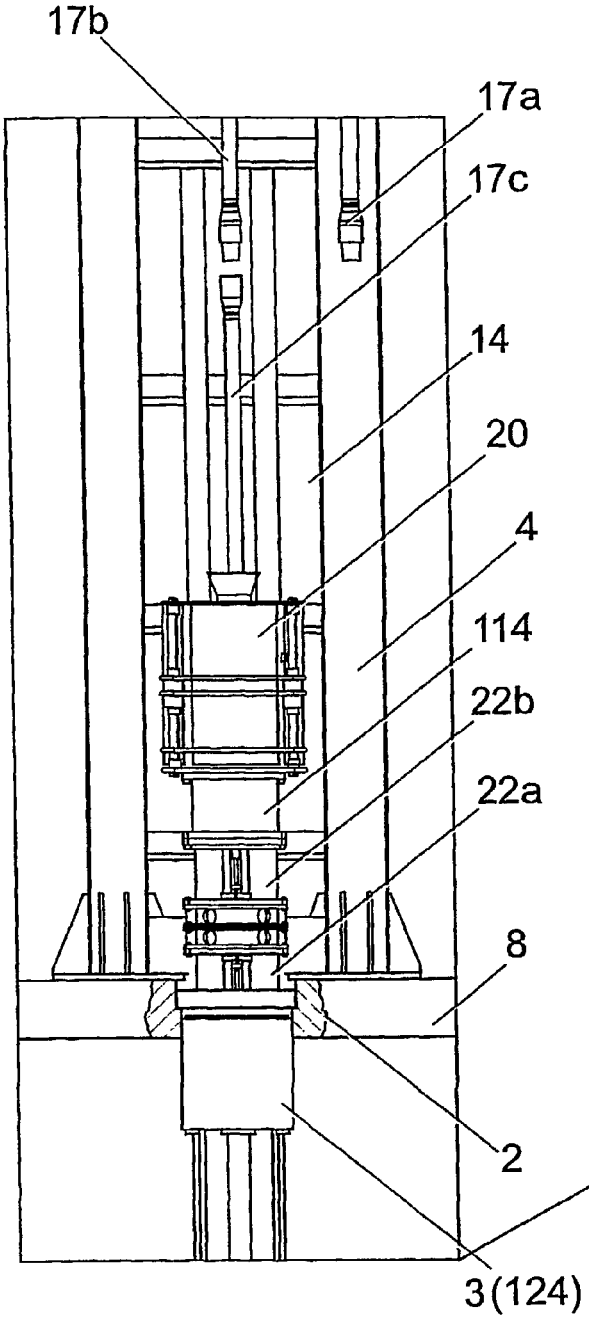
Figure 8B:
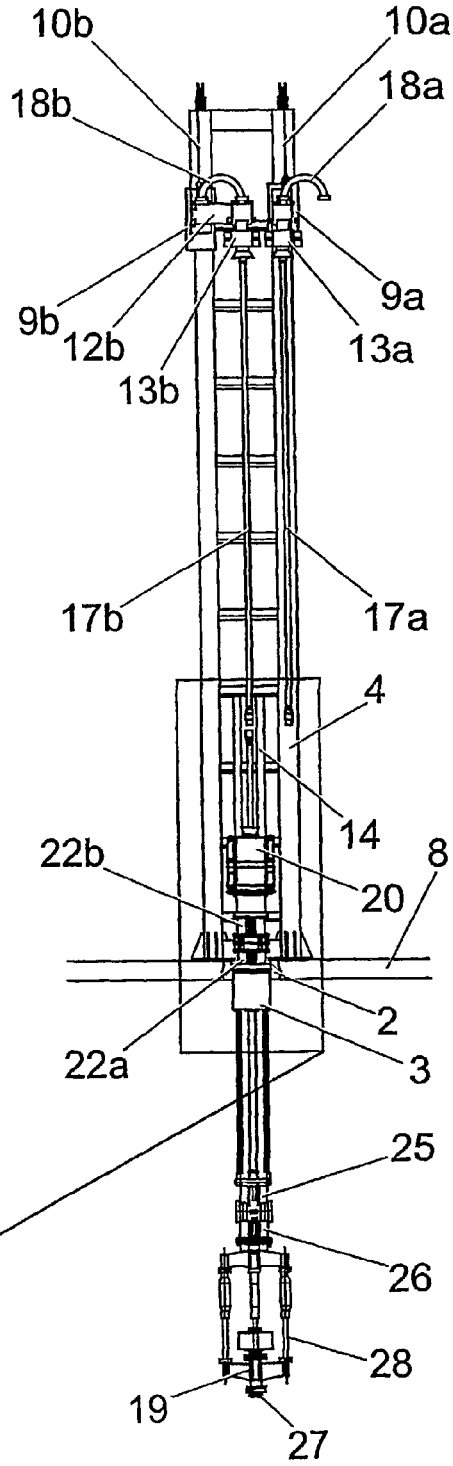

FIG. 8*a* is a cross-sectional more detailed view of a portion of the apparatus of FIG. 8*b;*

Figure 9A:
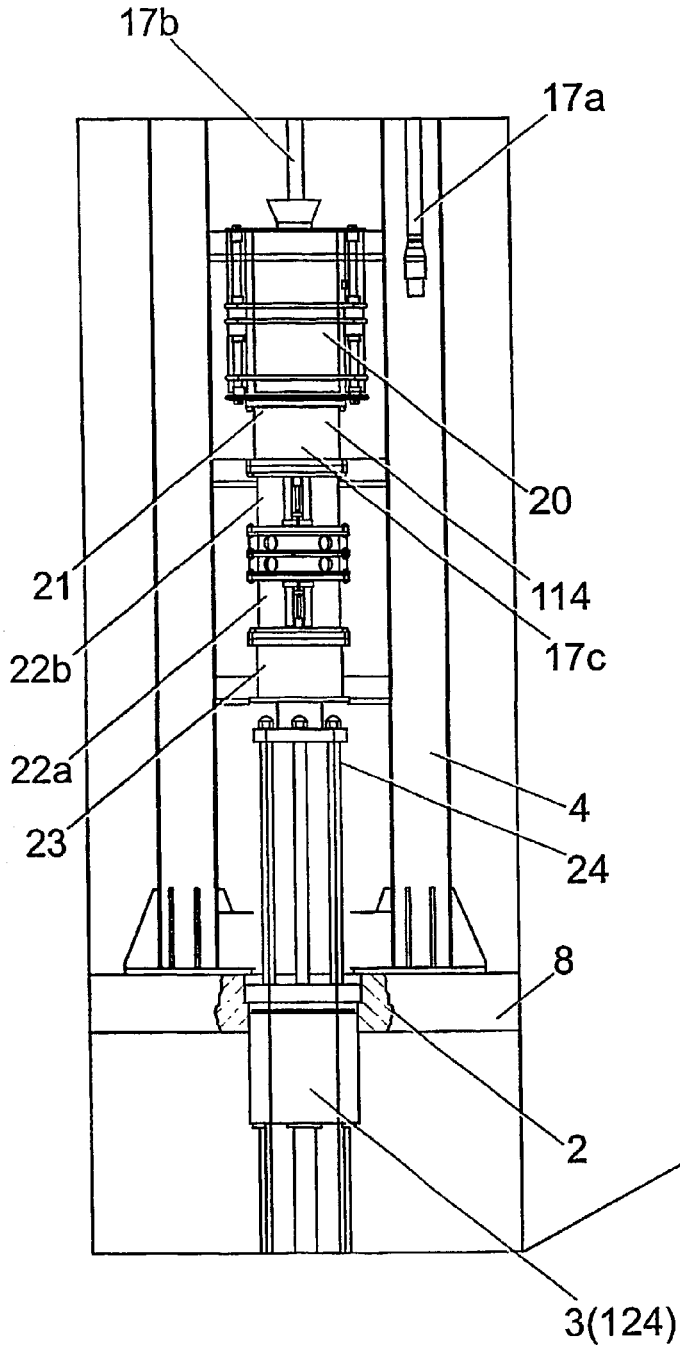
Figure 9B:
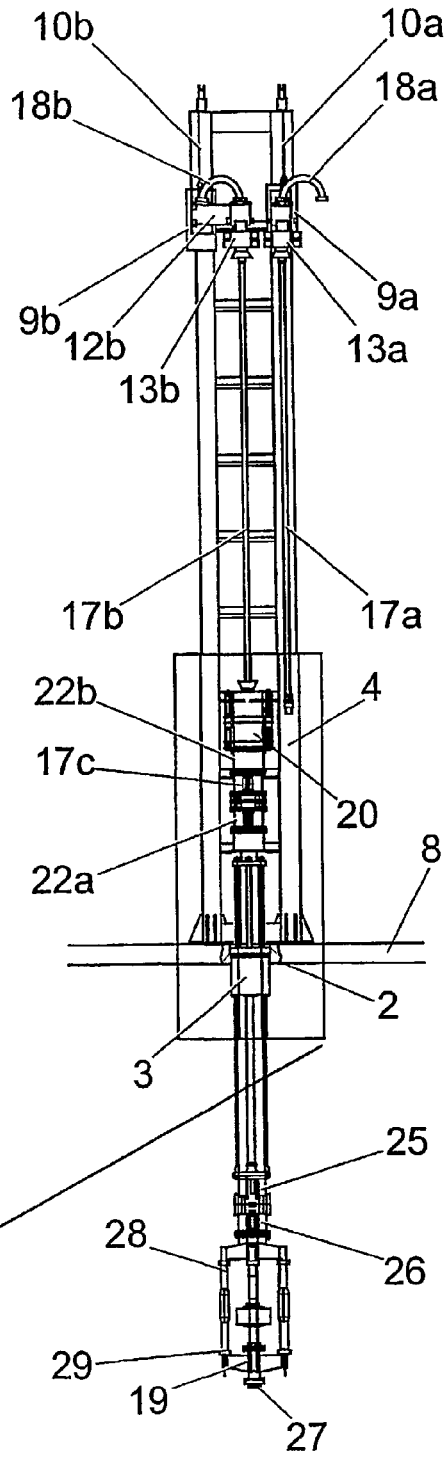

FIG. 8*b* is a front cross-sectional view of a portion of the derrick of the drilling rig of FIG. 1;

FIG. 9*a* is a cross-sectional more detailed view of a portion of the derrick of FIG. 9*b;*

Figure 10A:
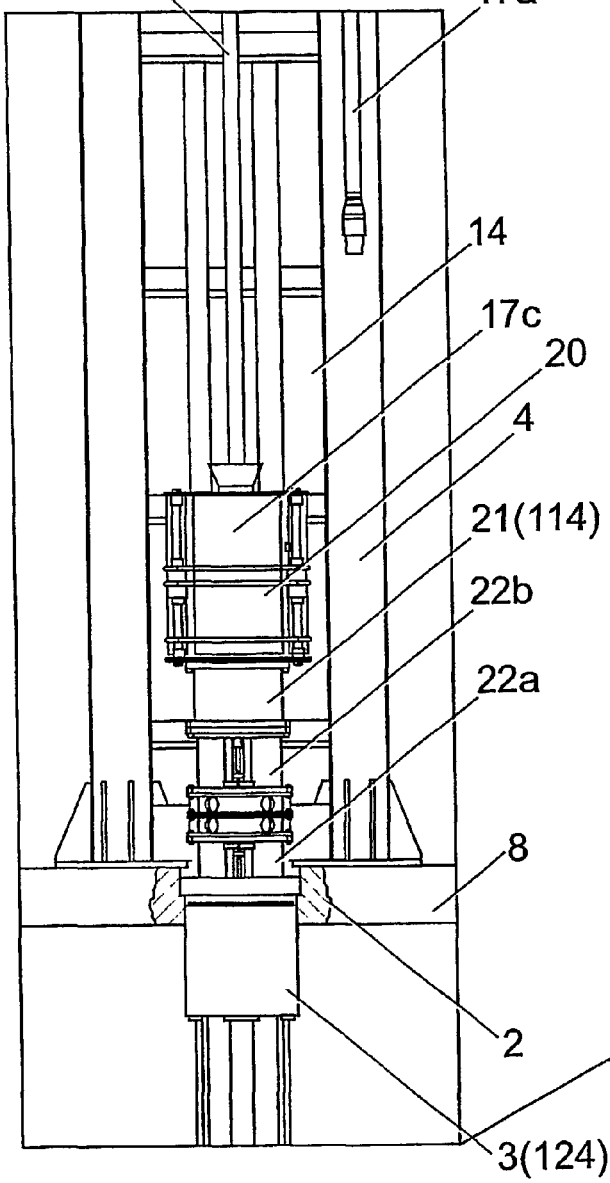
Figure 10B:
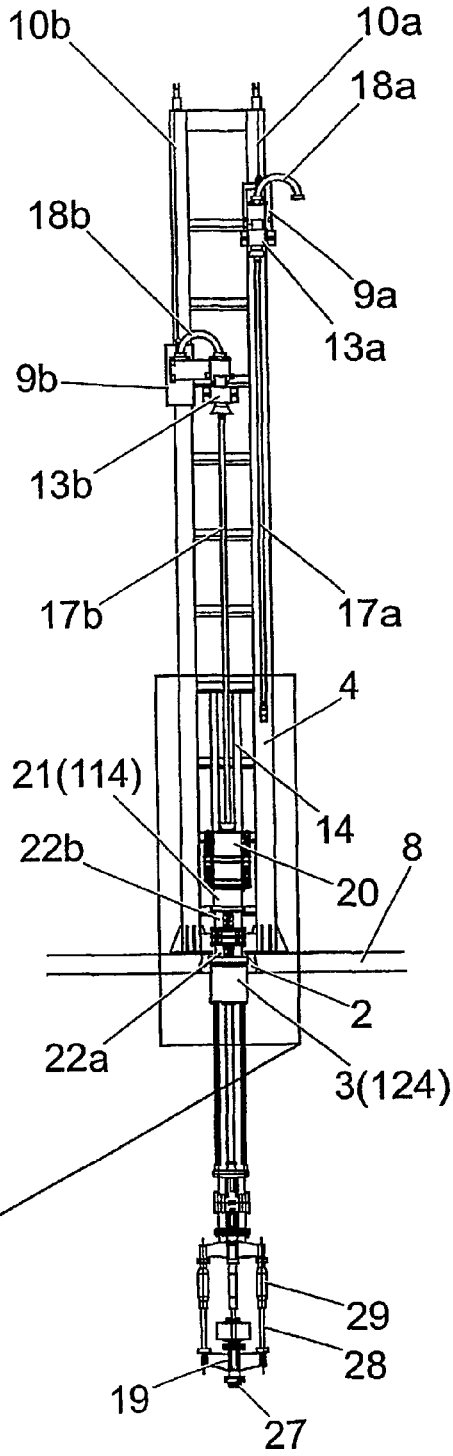

FIG. 9*b* is a front cross-sectional view of the derrick of the drilling rig of FIG. 1;

FIG. 10*a* is a more detailed view of a portion of the apparatus of FIG. 10*b;*

Figure 11A:
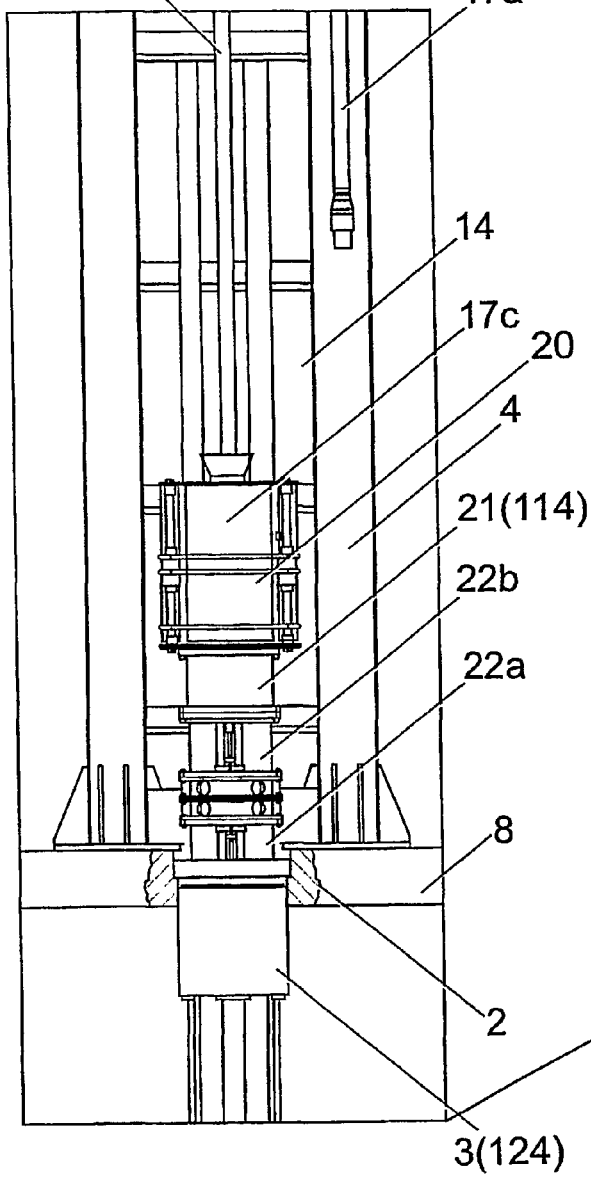
Figure 11B:
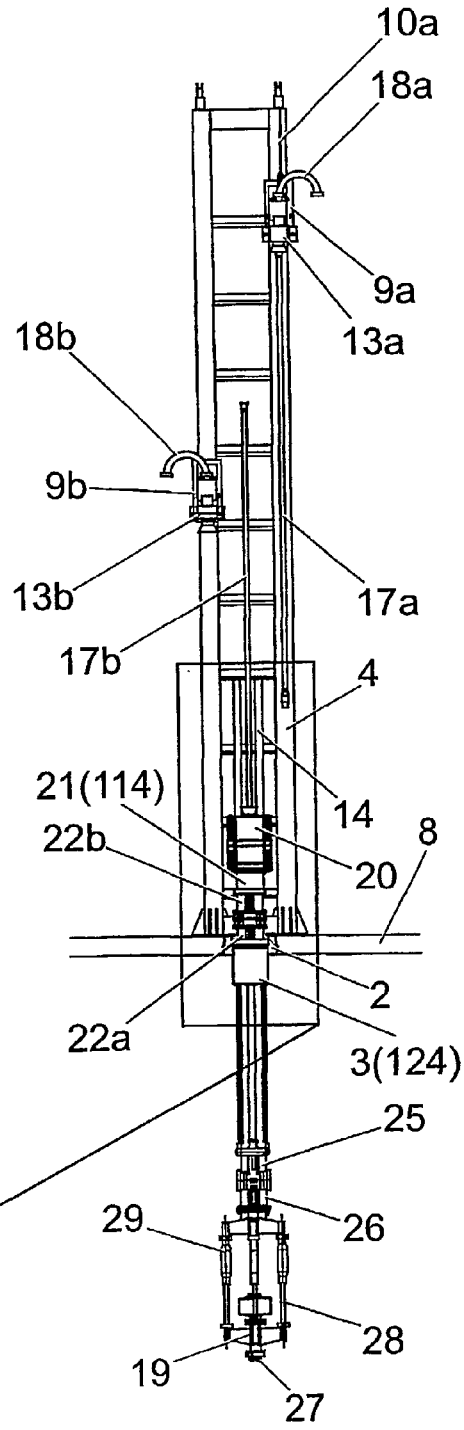

FIG. 10*b* is a front view of the derrick of FIG. 1;

FIG. 11*a* is a more detailed view of a portion of the apparatus of FIG. 11*b;*

Figure 12A:
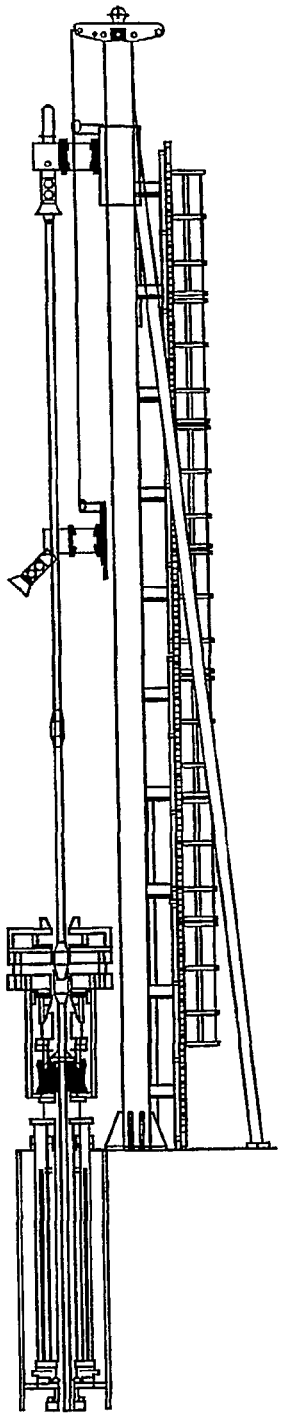
Figure 12B:
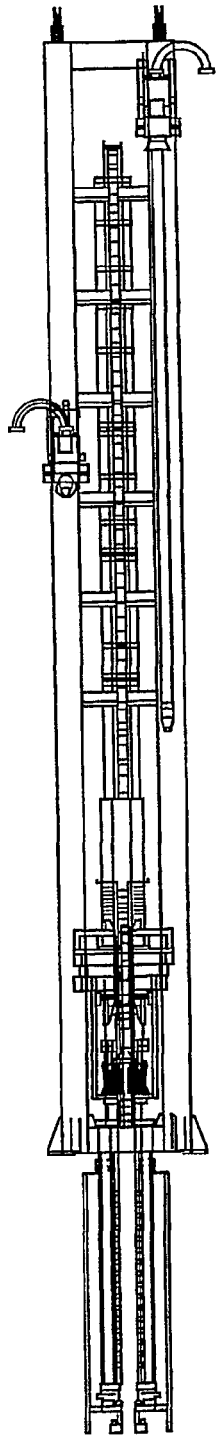
Figure 13A:
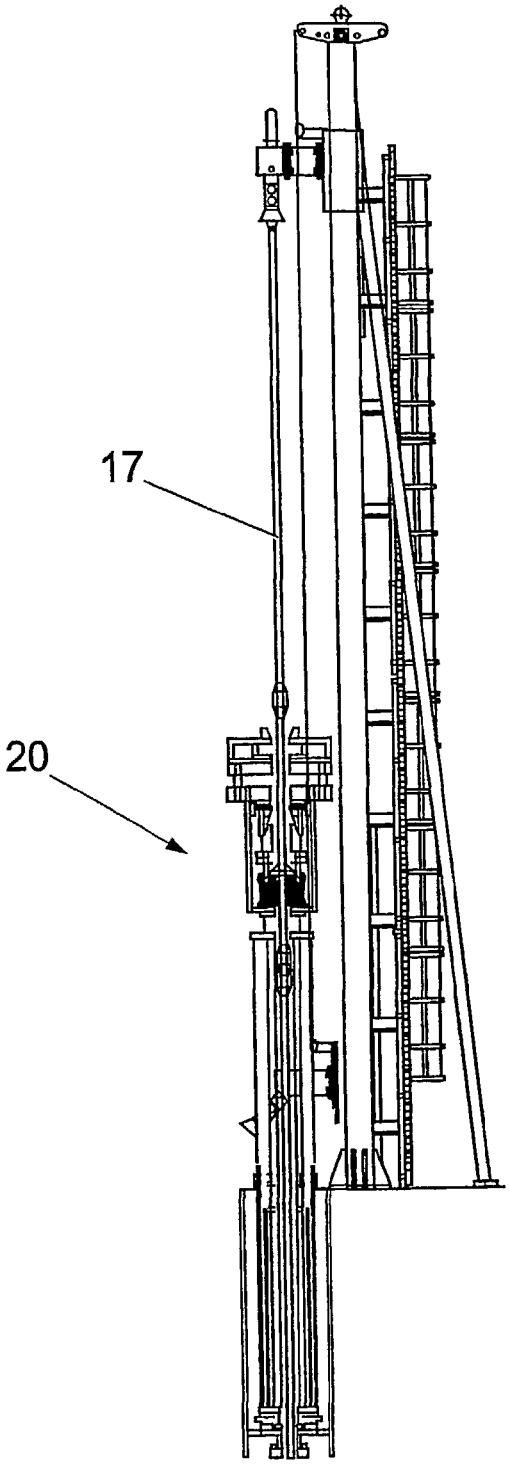
Figure 13B:
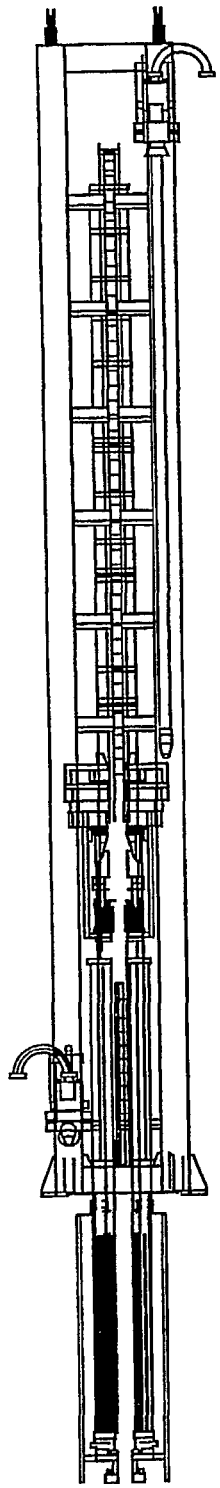
Figure 14A:
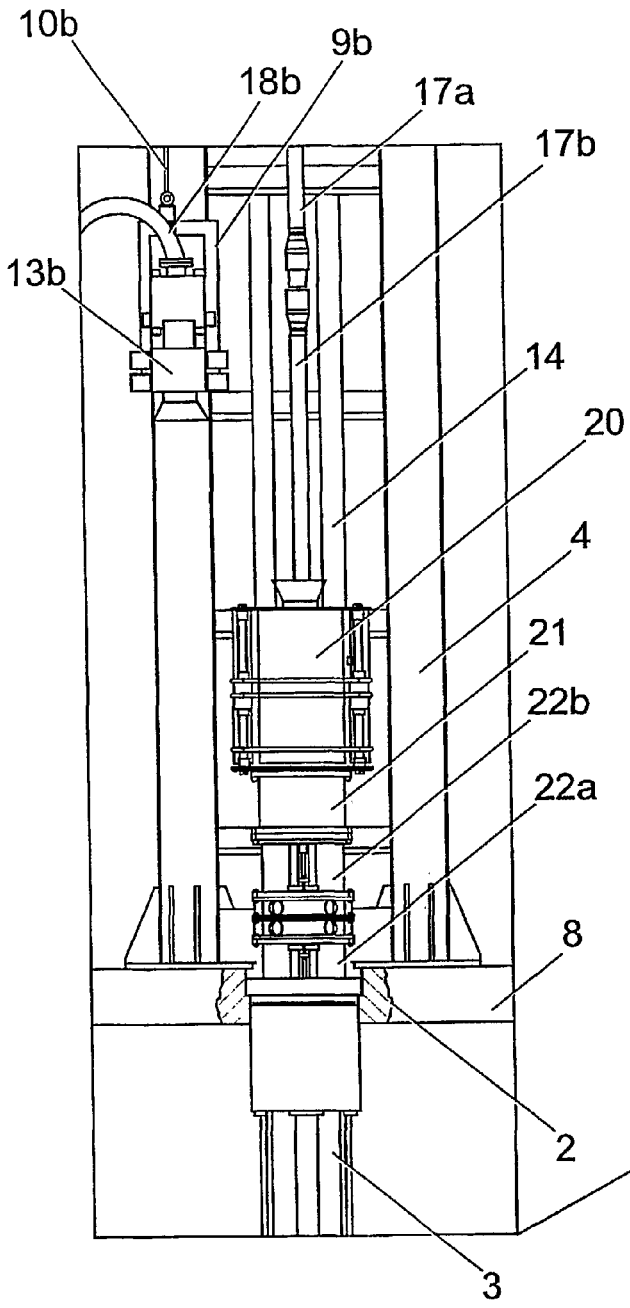
Figure 14B:
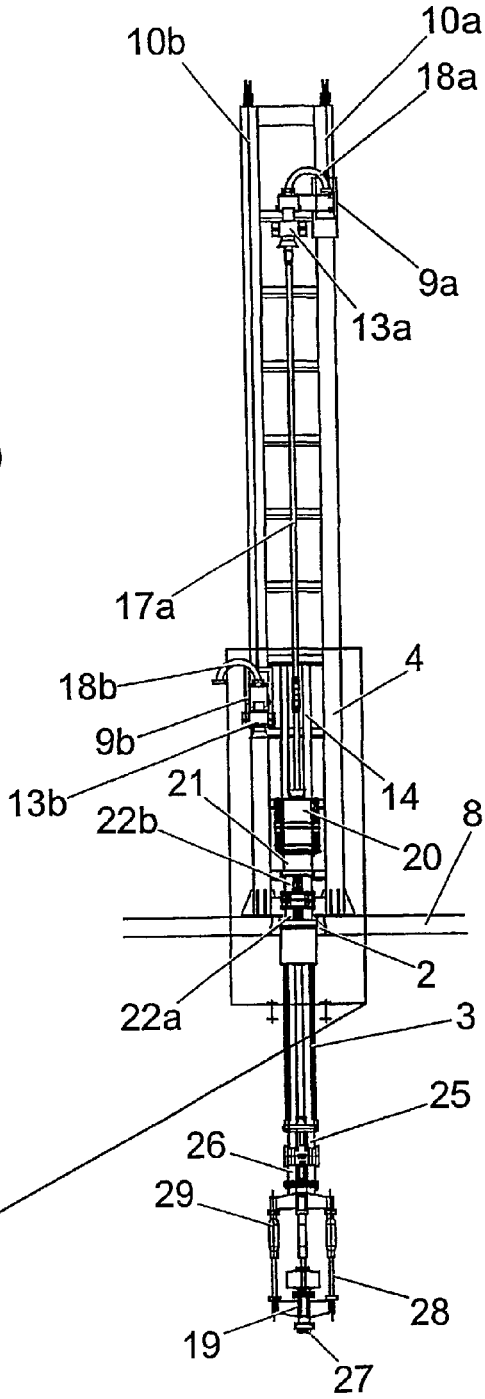

FIG. 11*b* is a front view of the derrick of FIG. 1;

FIG. 12*a* is a side view of the derrick of FIG. 1;

FIG. 12*b* is a front view of the derrick of FIG. 1;

FIG. 13*a* is a side view of the derrick of FIG. 1;

FIG. 13*b* is a front view of the derrick of FIG. 1;

FIG. 14*a* is a more detailed view of the portion of the apparatus of FIG. 14*b;*

Figure 15A:
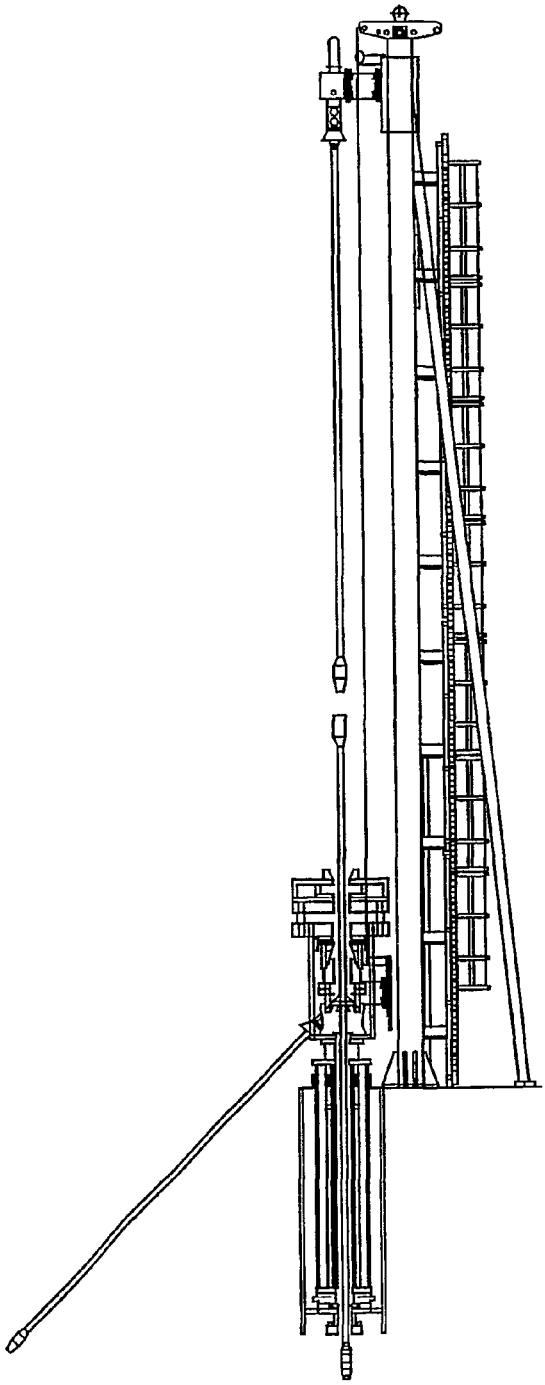
Figure 15B:
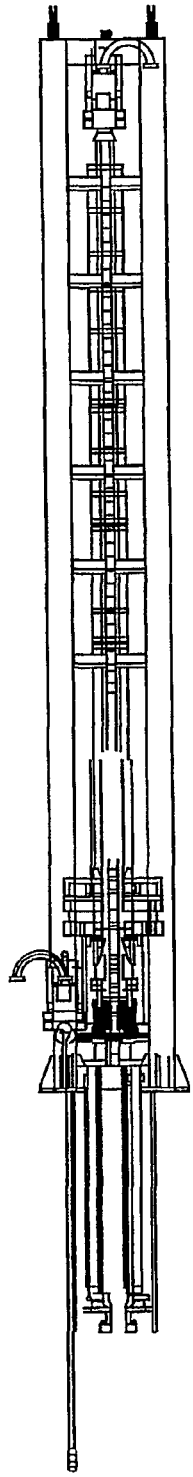
Figure 16A:
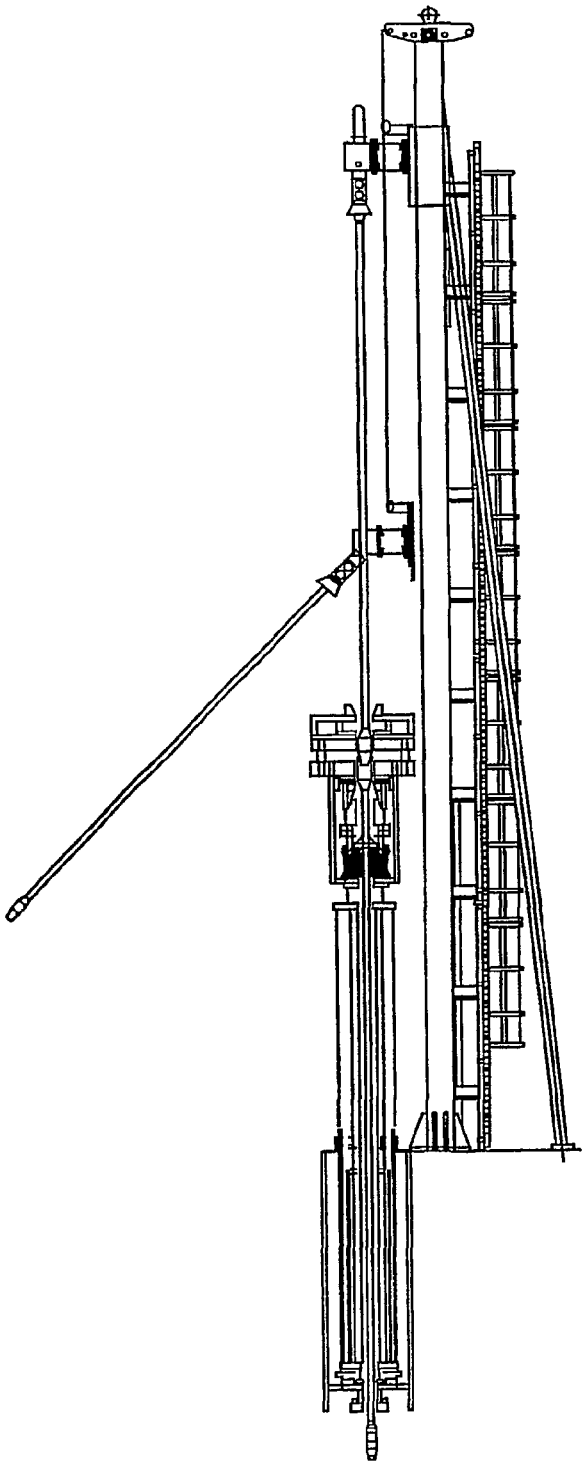
Figure 16B:
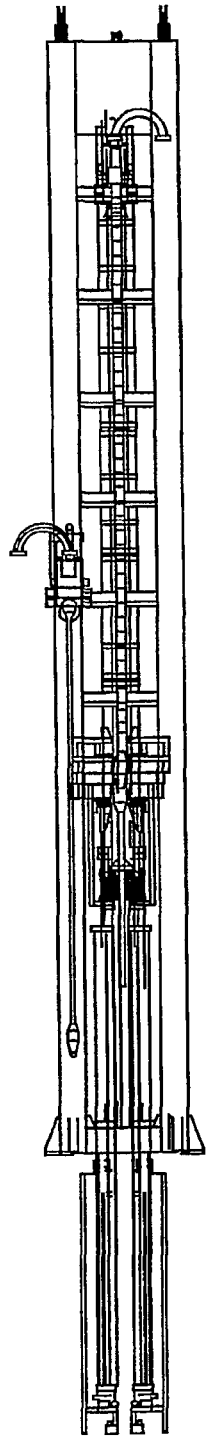
Figure 17A:
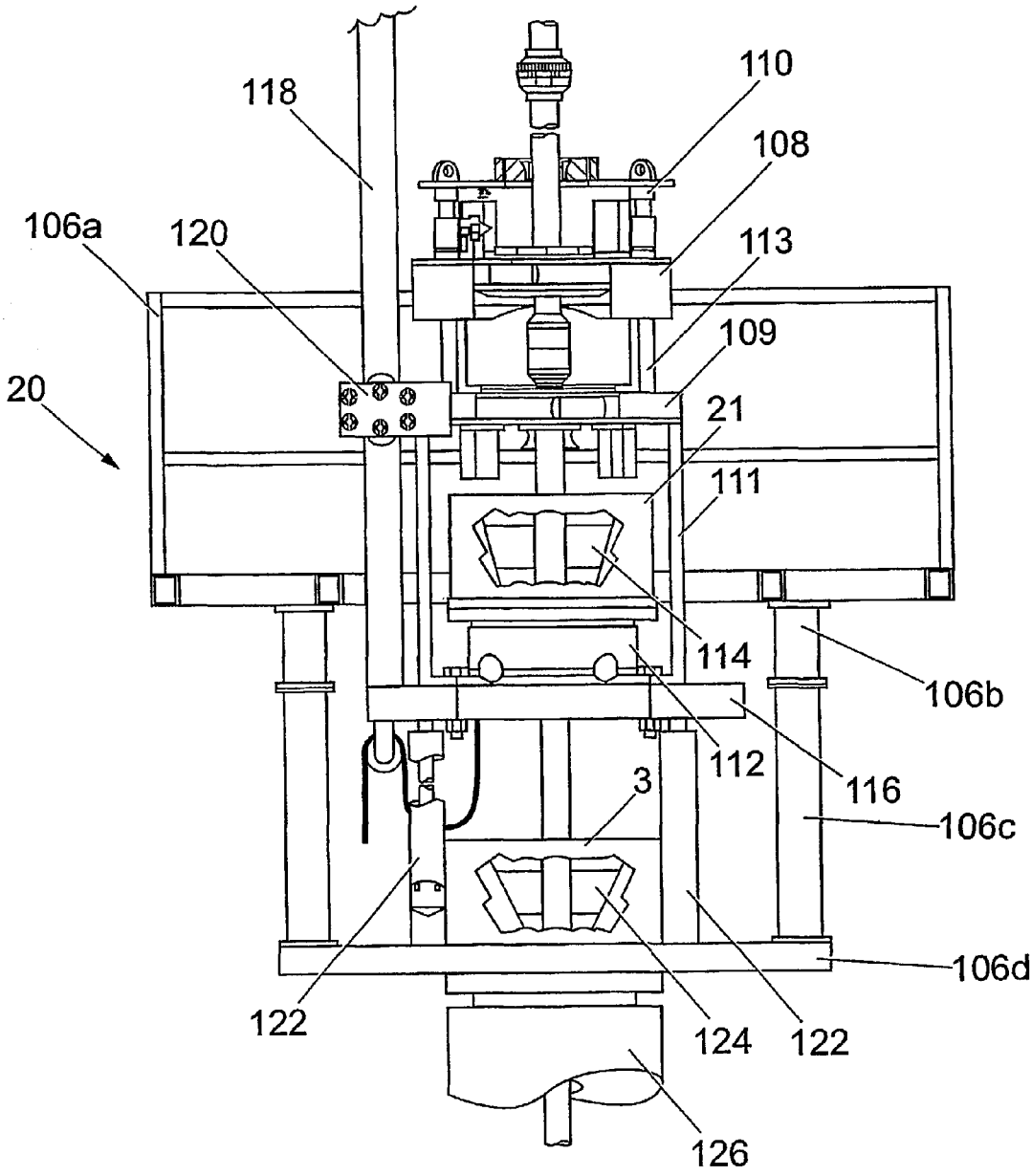
Figure 17C:
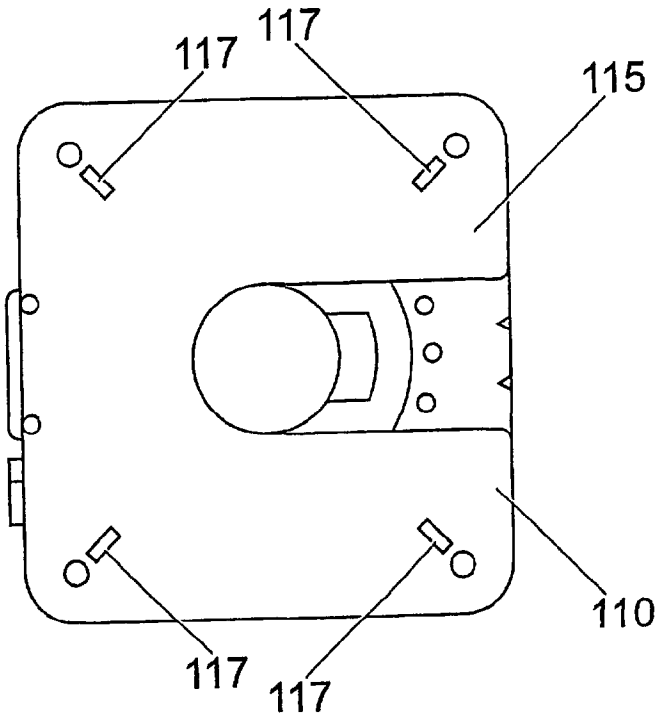
Figure 17B:
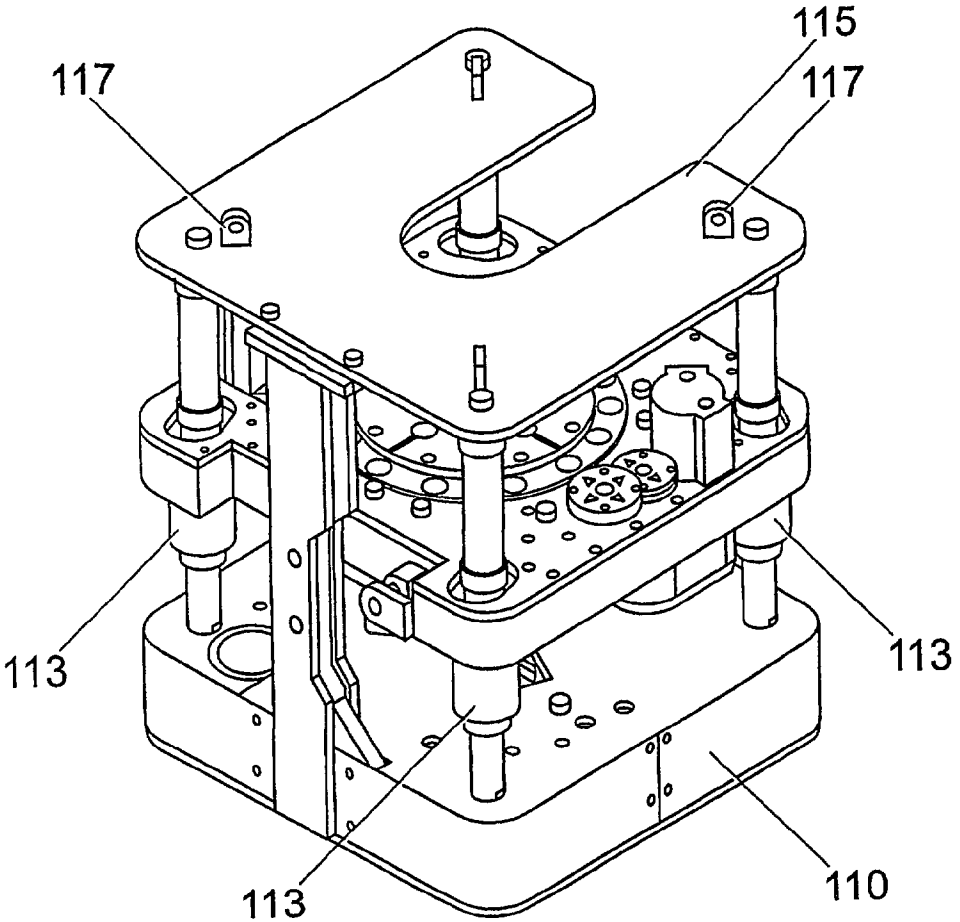

FIG. 14*b* is a front view of the derrick of FIG. 1;

FIG. 15*a* is a side view of the derrick of FIG. 1;

FIG. 15*b* is a front view of the derrick of FIG. 1;

FIG. 16*a* is a side view of the derrick of FIG. 1;

FIG. 16*b* is a front view of the derrick of FIG. 1;

FIG. 17*a* is a front view of upper and lower tongs mounted within a snubbing unit;

FIG. 17*b* is a perspective view of a portion of the snubbing unit of FIG. 17*a;*

FIG. 17*c* is a top view of a portion of the snubbing unit of FIG. 17*a;*

Figure 17E:
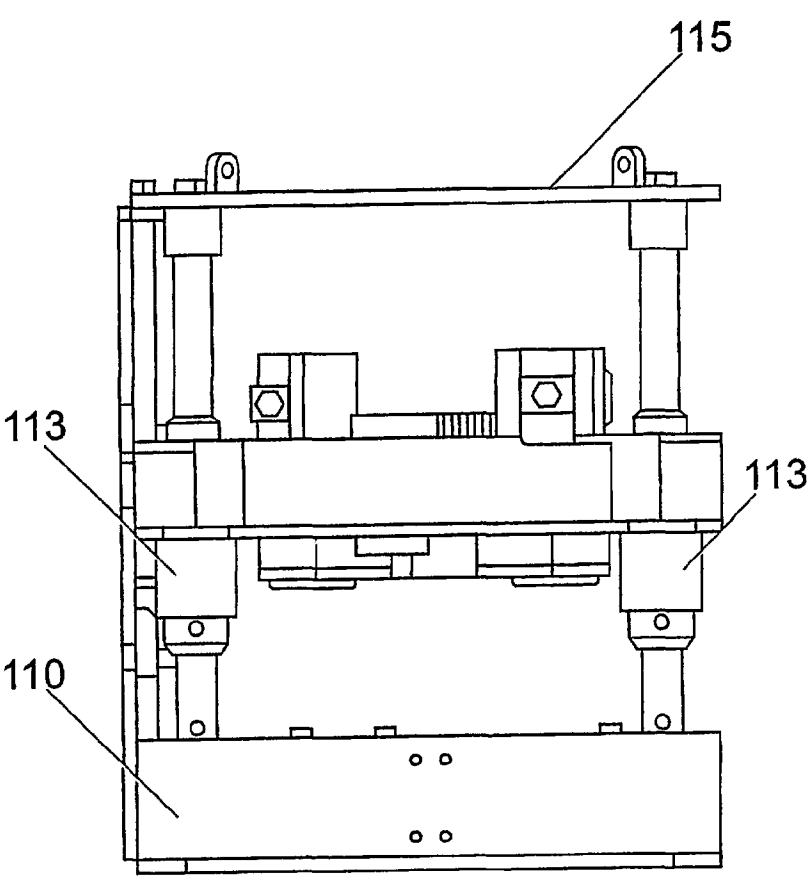
Figure 17D:
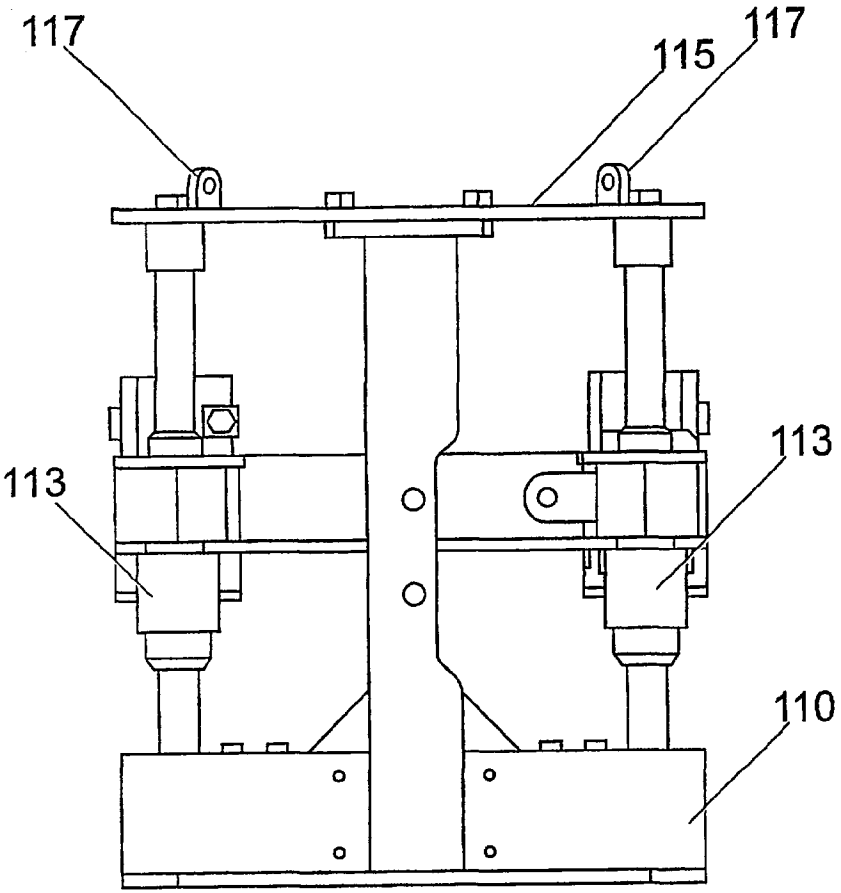

FIG. 17*d* is a rear view of a portion of the snubbing unit of FIG. 17*a;*

FIG. 17*e* is a side view of a portion of the snubbing unit of FIG. 17*a;*

Figure 18:
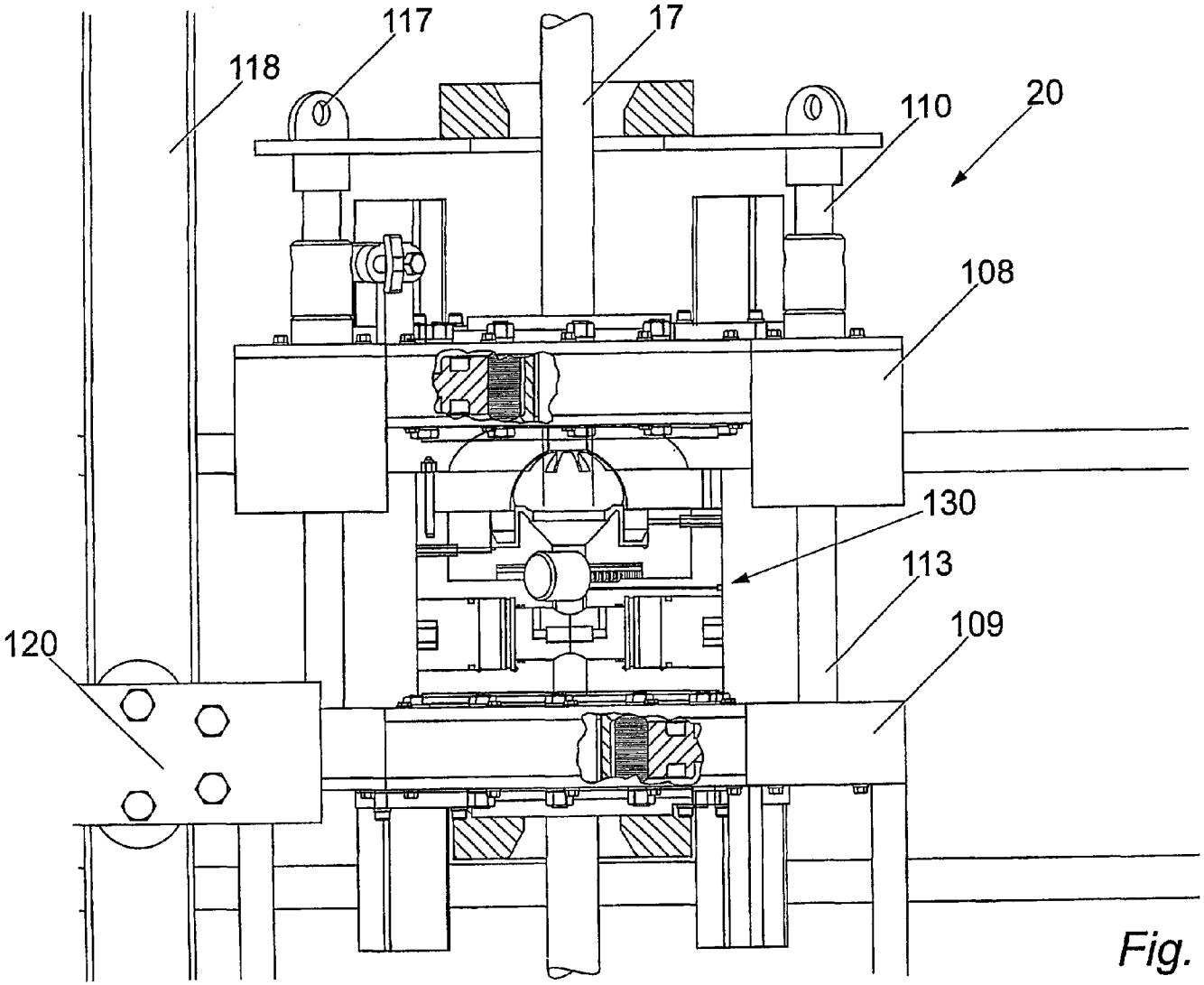

FIG. 18 is a more detailed part cross-sectional view of a portion of the snubbing unit of FIG. 17*a;*

Figure 19:
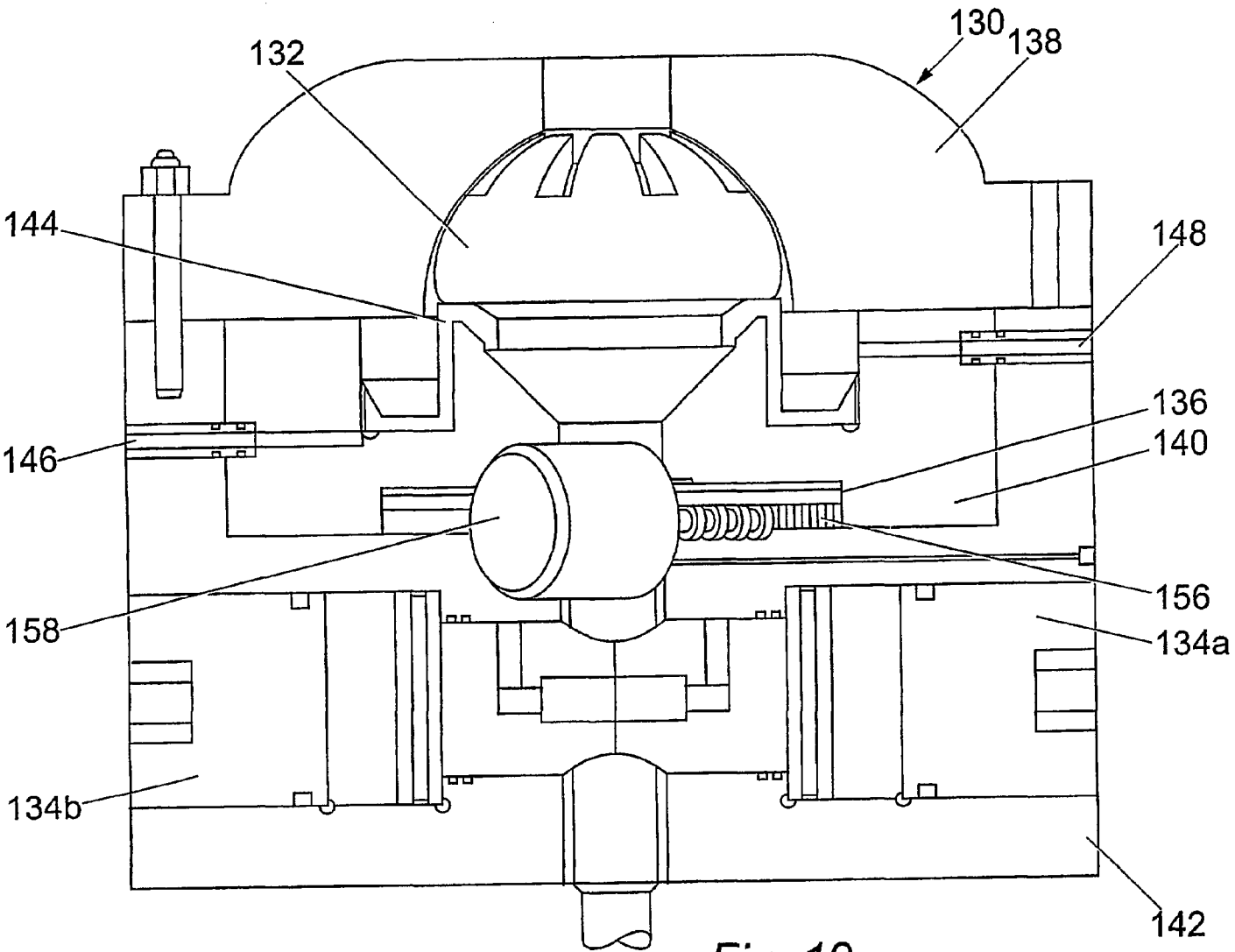

FIG. 19 is a more detailed part cross-sectional view of the snubbing unit of FIG. 17*a;*

Figure 20:
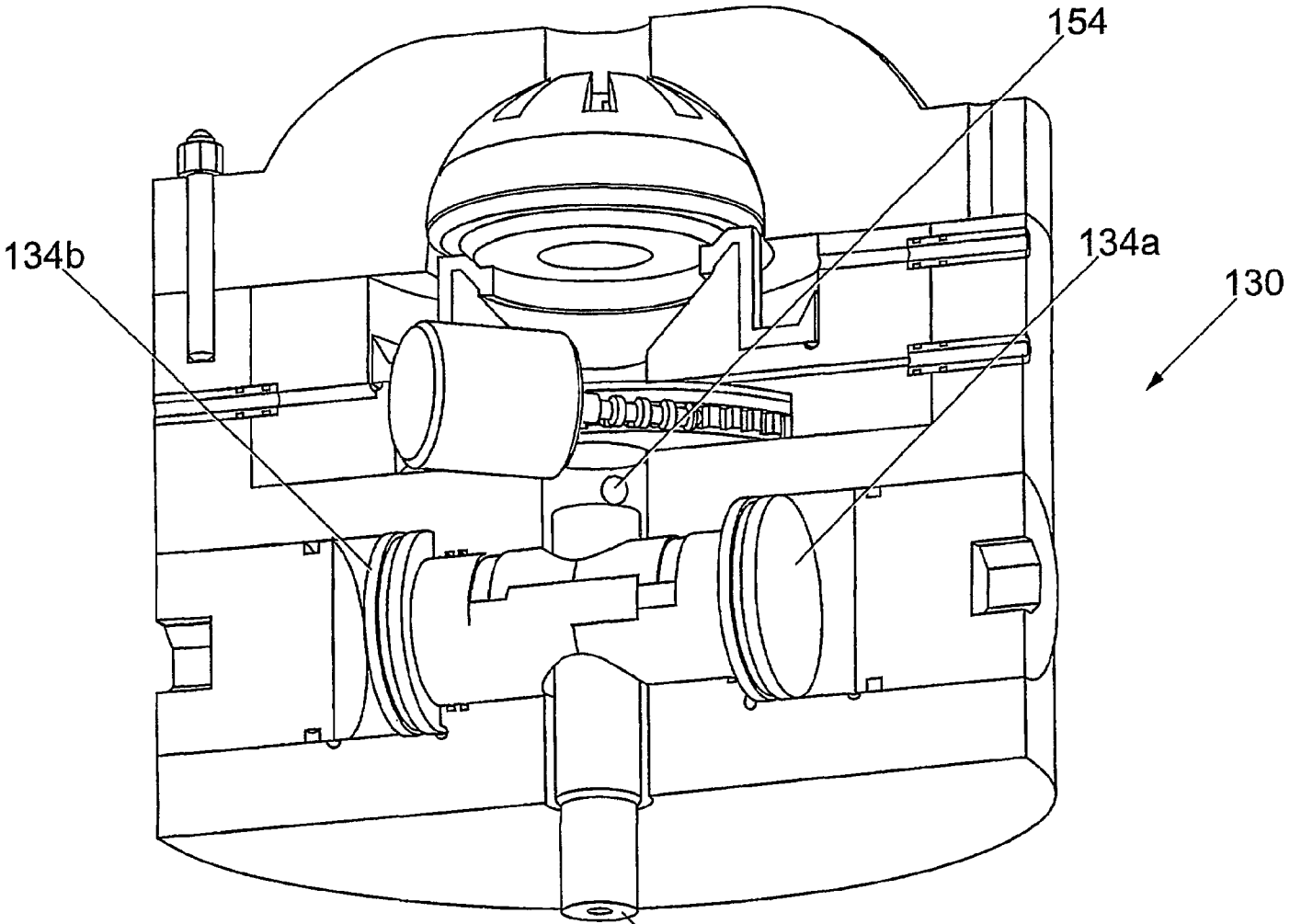

FIG. 20 is a more detailed part cross-sectional view of a portion of the snubbing unit of FIG. 17*a;*

Figure 21:
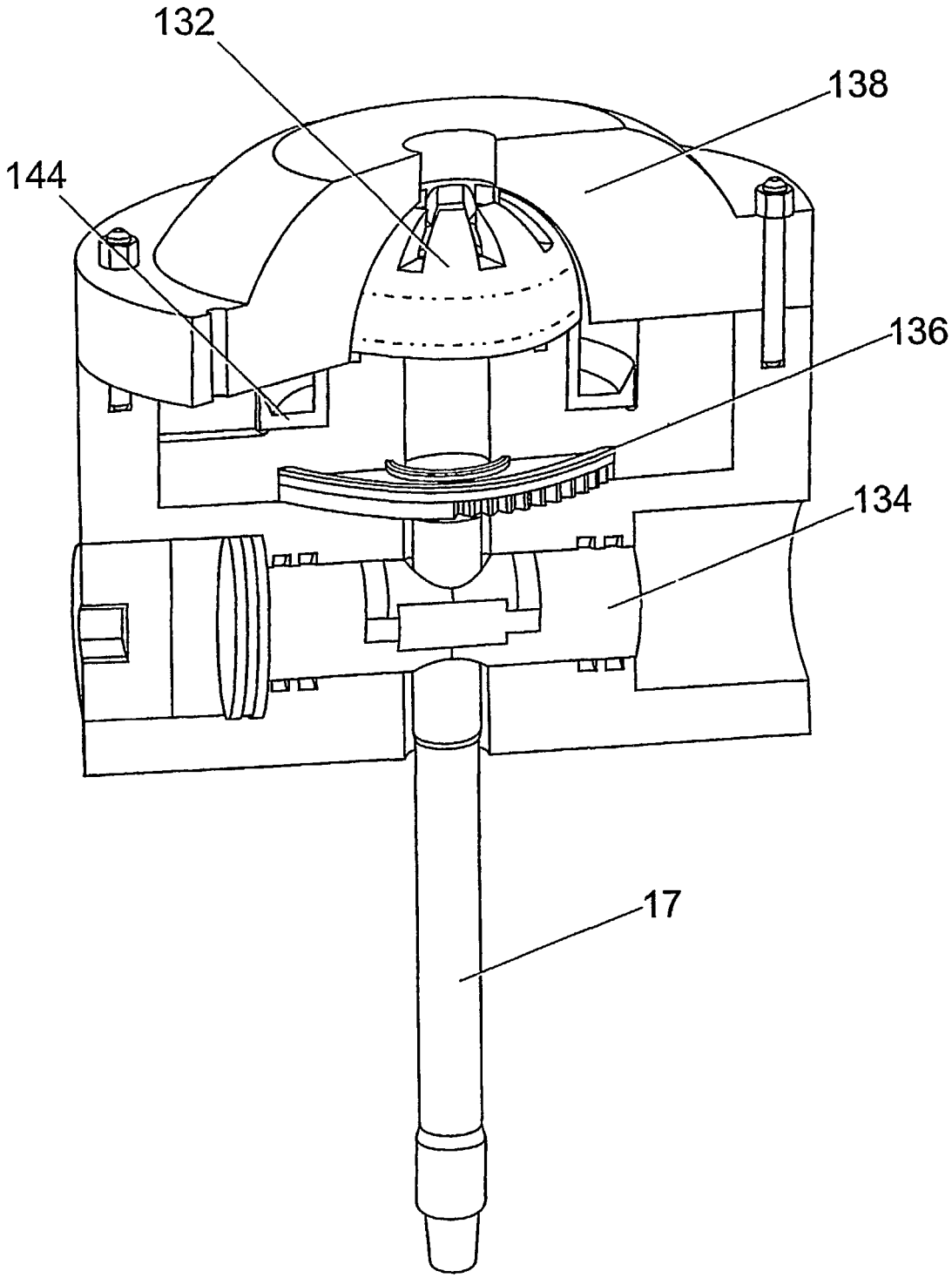

FIG. 21 is a more detailed part cross-sectional view of a portion of the snubbing unit of FIG. 17*a;*

Figure 22:
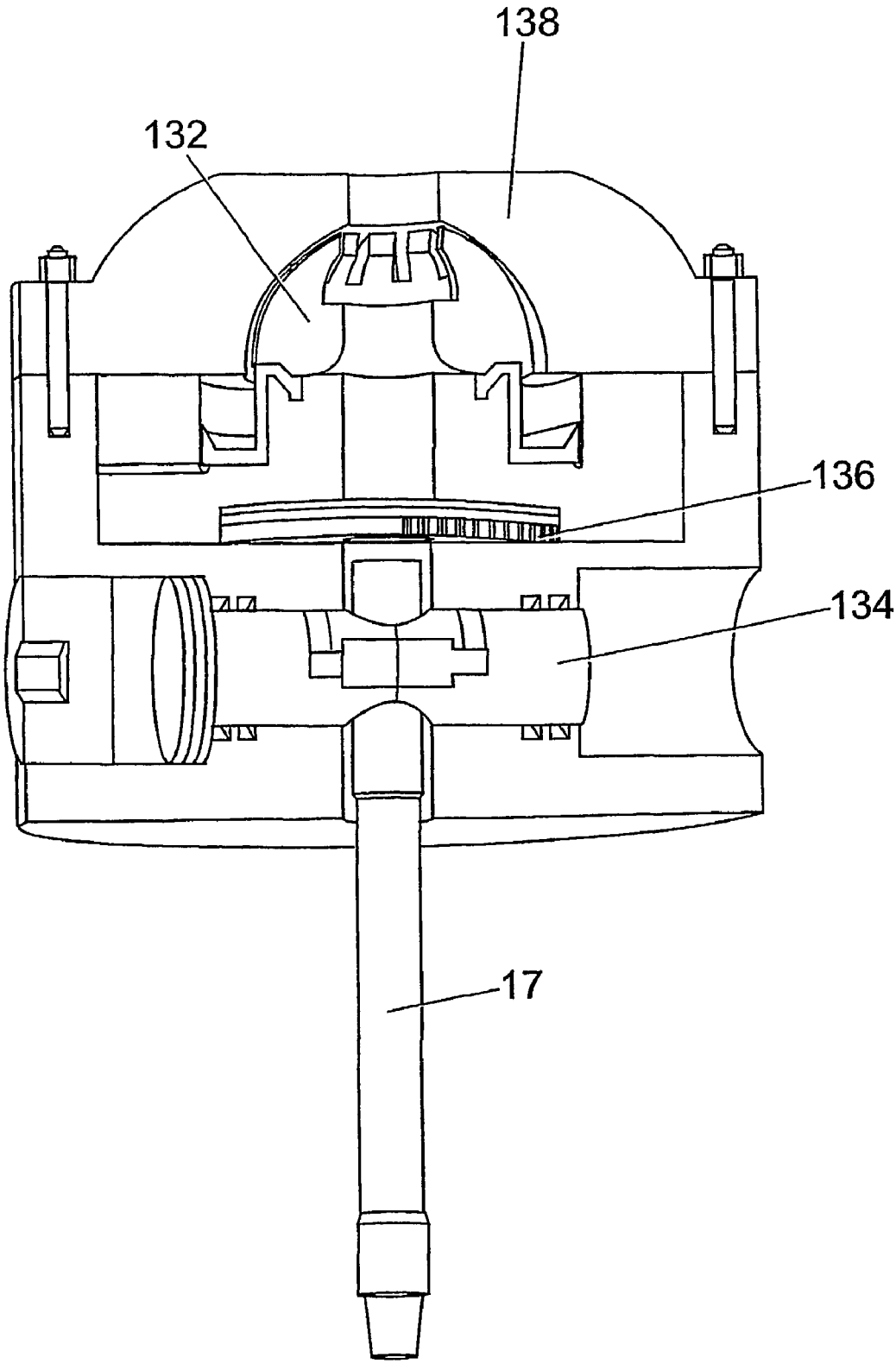

FIG. 22 is a more detailed part cross-sectional view of a portion of the snubbing unit of FIG. 17*a;*

Figure 23:
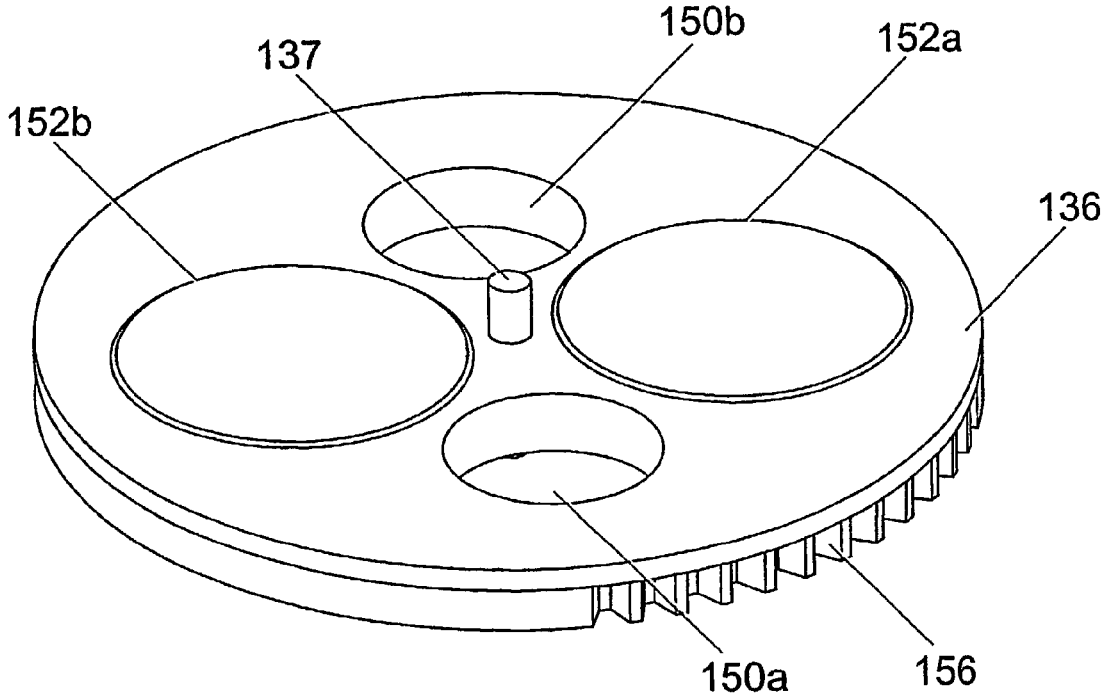

FIG. 23 is a perspective view of a valve plate of the snubbing unit of FIG. 17*a;*

Figure 24:
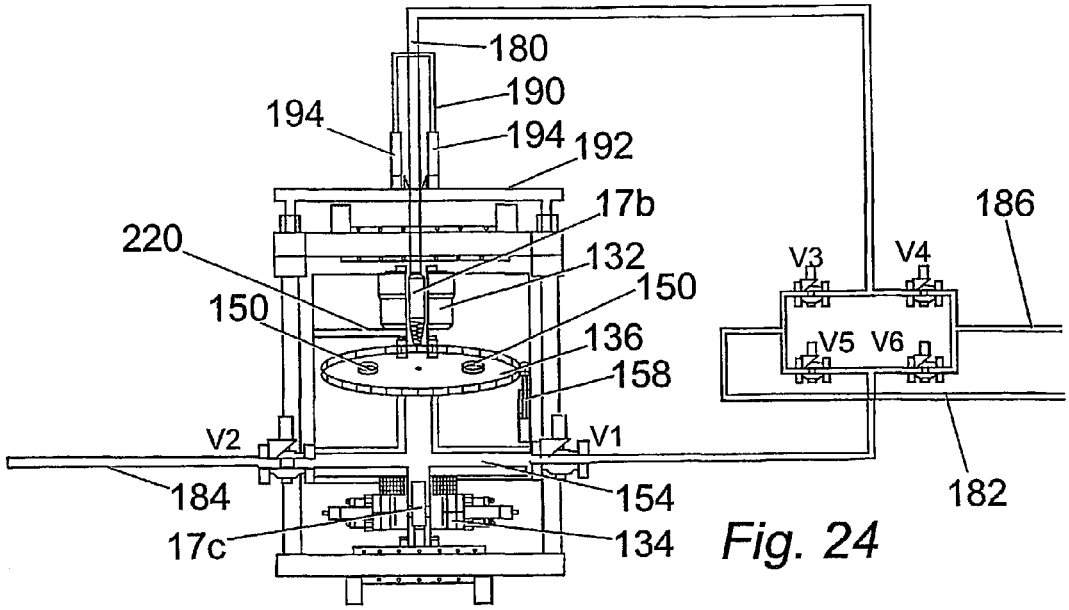
Figure 25:
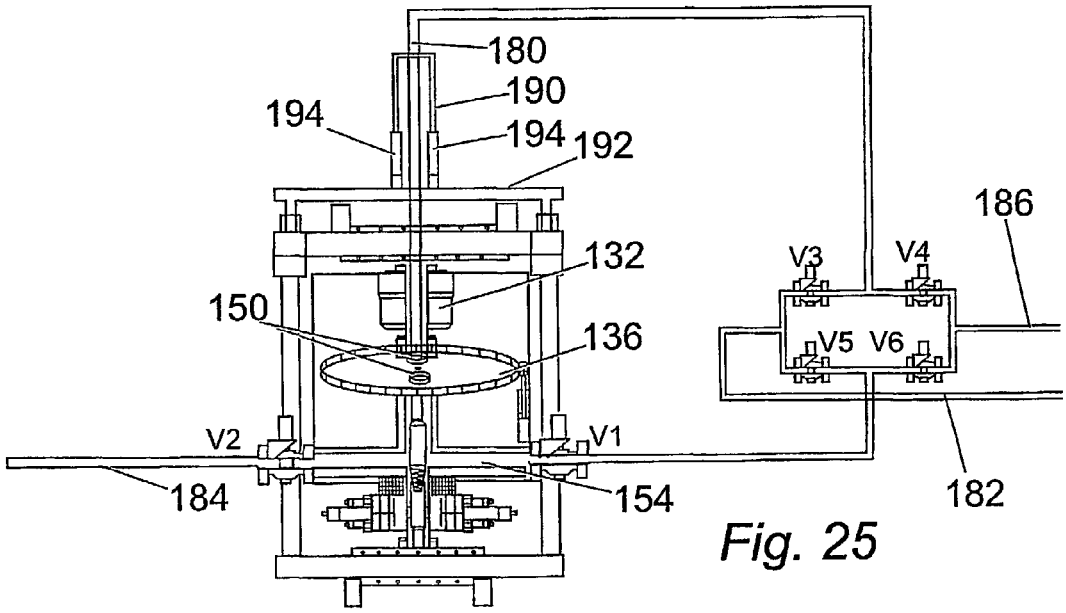
Figure 26:
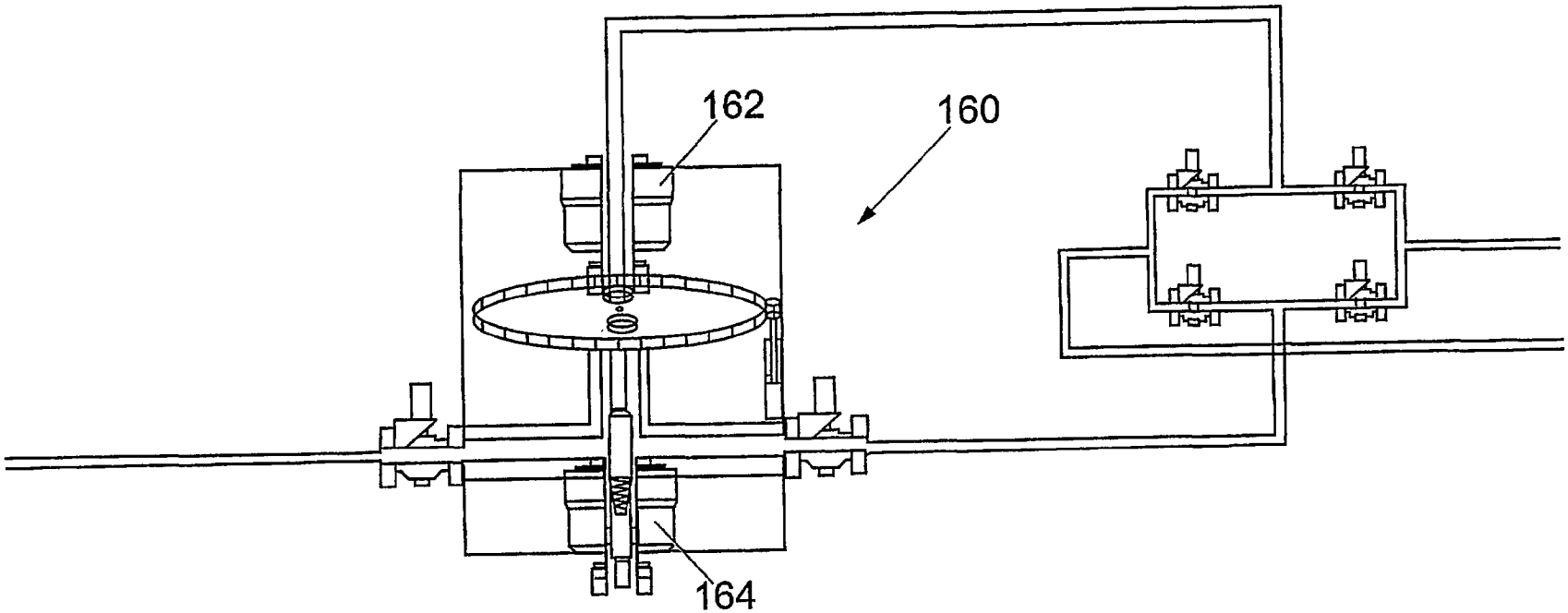
Figure 27:
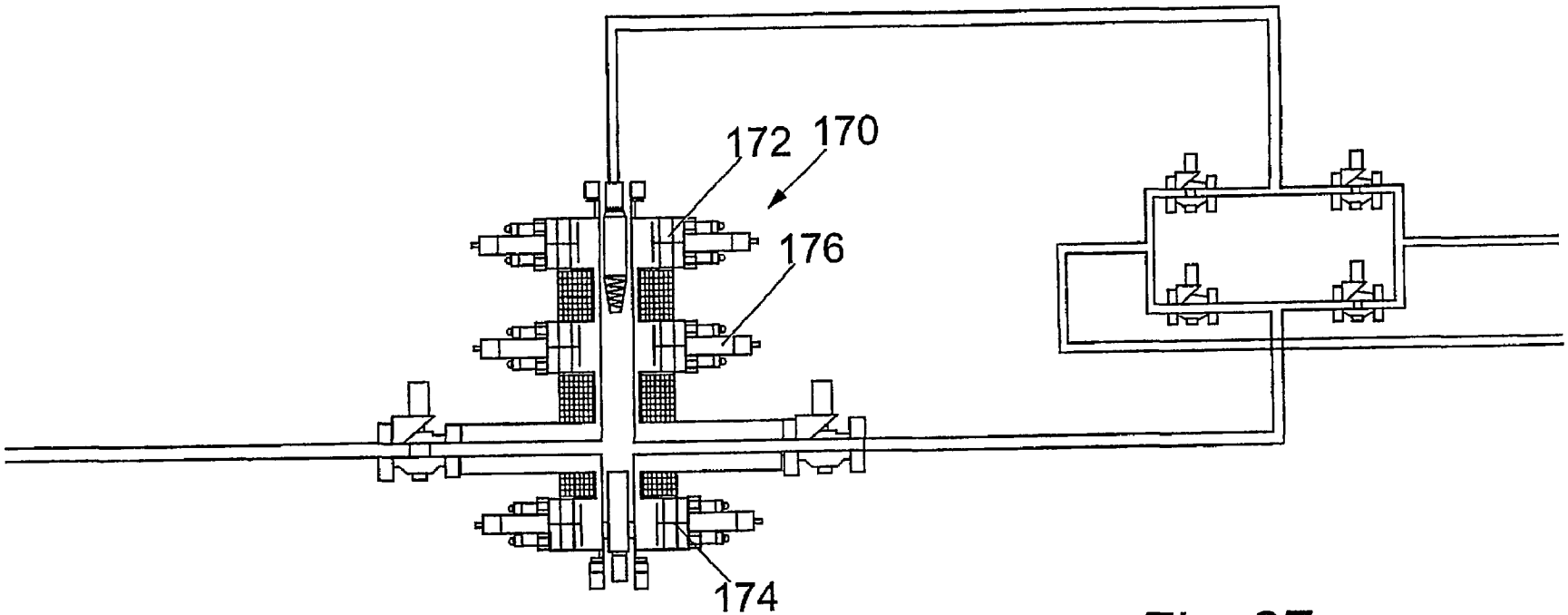
Figure 28:
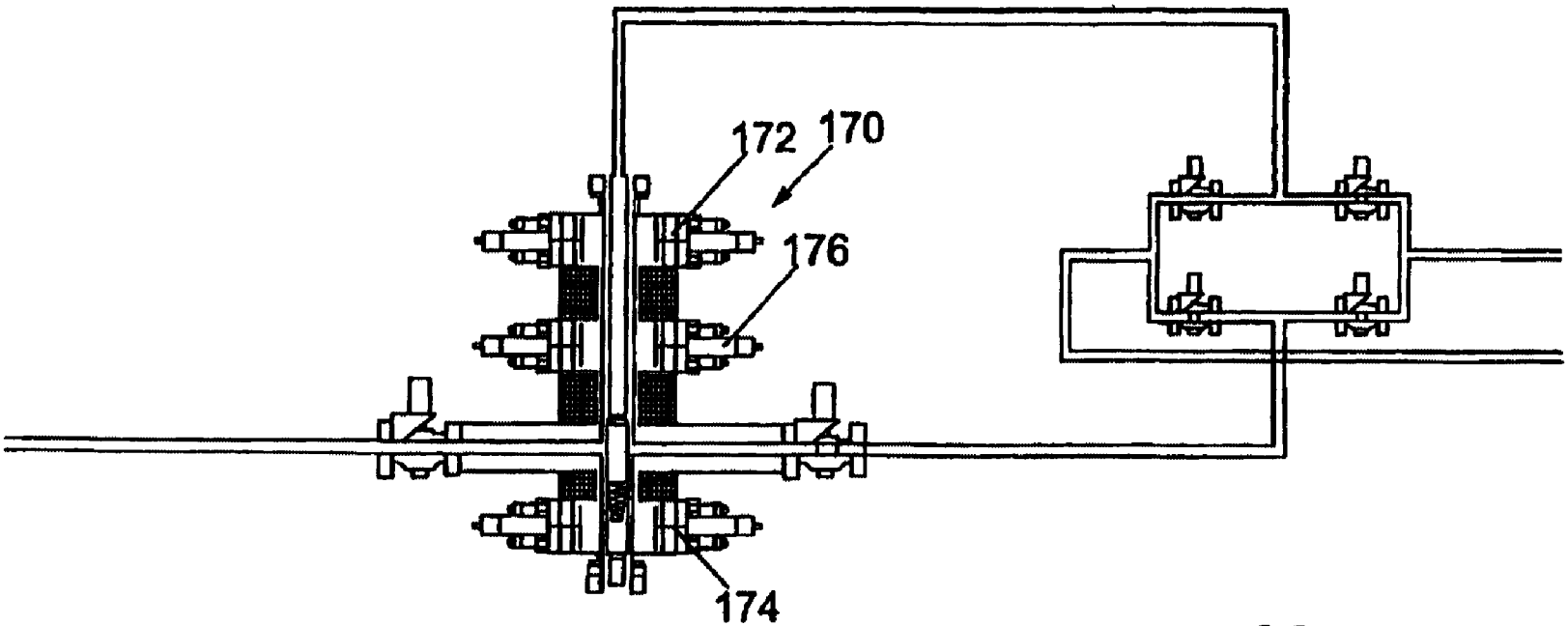
Figures 29, 30, 31:
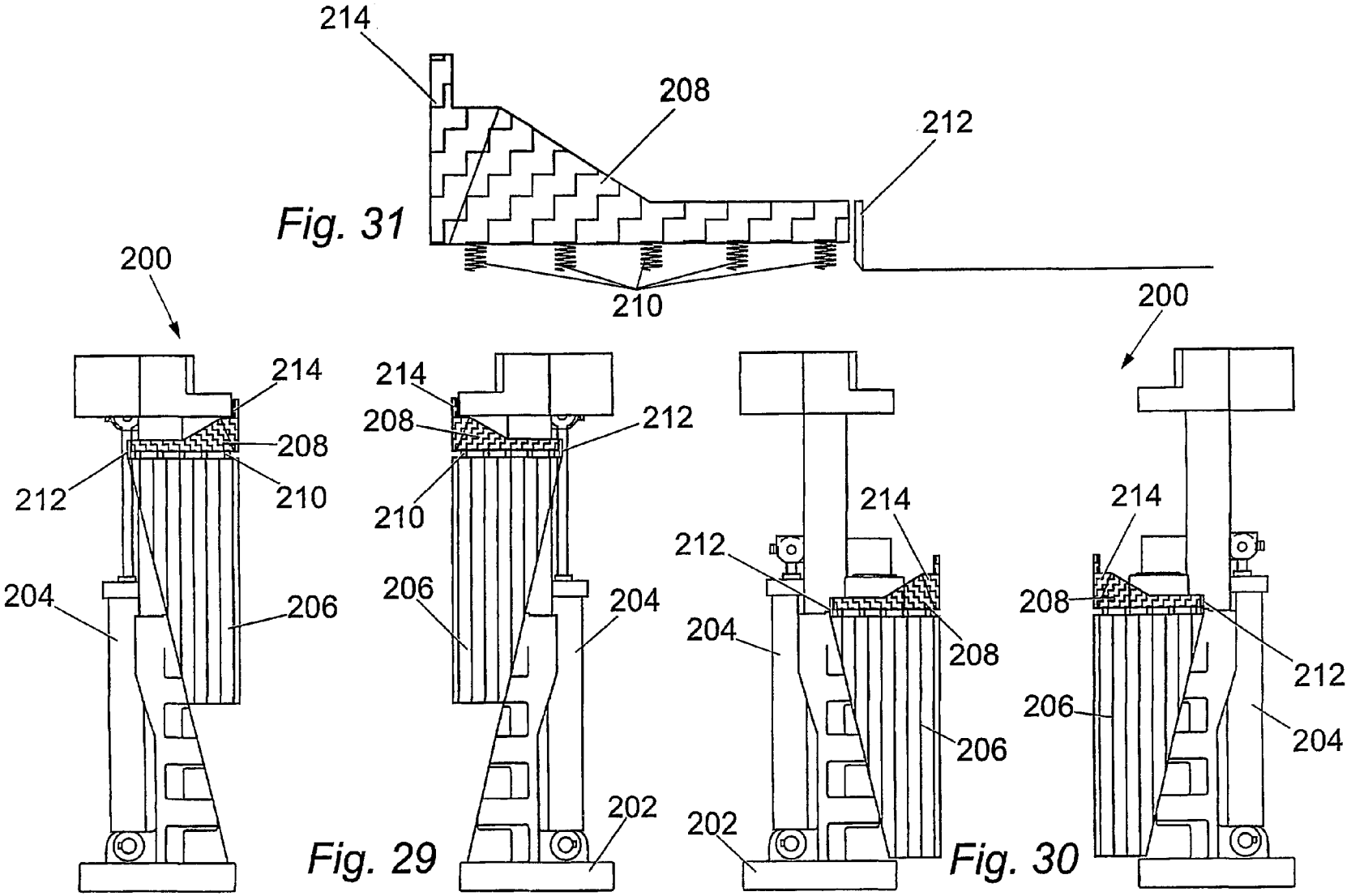
Figure 34:
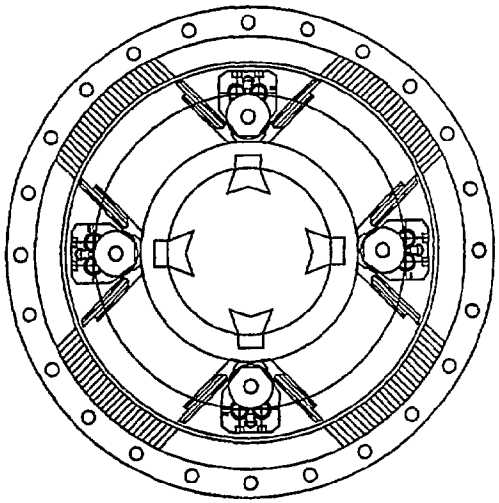
Figure 33:
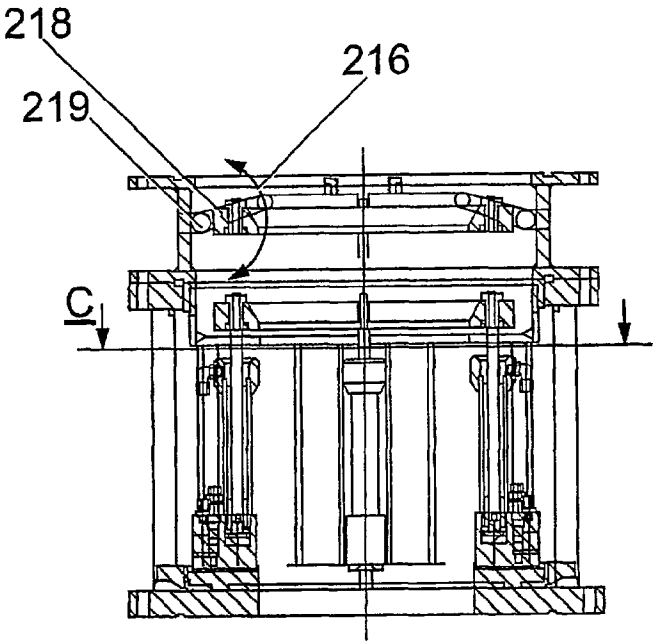
Figure 32:
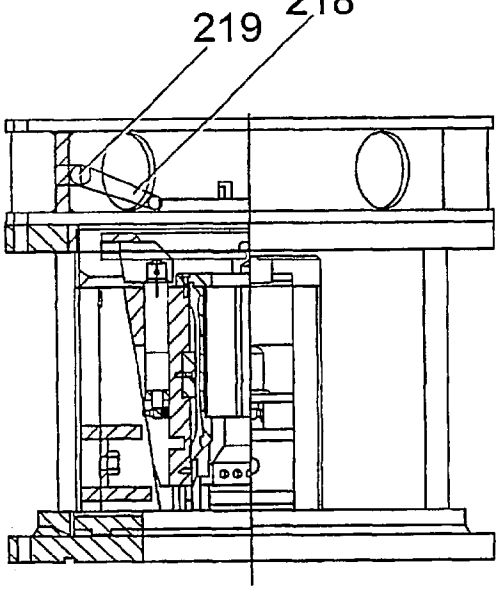

FIG. 24 is a schematic view of the snubbing unit of FIG. 17*a* showing a continuous circulation configuration with a main valve closed;

FIG. 25 is a schematic view of the snubbing unit of FIG. 17*a* in a continuous circulation configuration with the main valve open;

FIG. 26 is a schematic view of the snubbing unit of FIG. 17*a* incorporating a stripper design;

FIG. 27 is a schematic view of the snubbing unit of FIG. 17*a* incorporating a ram design in a first configuration;

FIG. 28 is a schematic view of the snubbing of FIG. 17*a* incorporation a ram design in a second configuration;

FIG. 29 is a cross-sectional view of a first embodiment of a safety slip mechanism, in accordance with a twelfth aspect of the present invention, in an open configuration;

FIG. 30 is a cross-sectional view of the safety slip mechanism of FIG. 29 in a closed configuration;

FIG. 31 is a cross-sectional view of a portion of the safety slip mechanism of FIG. 29;

FIG. 32 is a half cross sectioned view of a second embodiment of a safety slip mechanism, in accordance with the twelfth aspect of the present invention, in a closed configuration;

FIG. 33 is a cross-sectional view of the second embodiment of the safety slip mechanism of FIG. 32, but in an open configuration; and FIG. 34 is a cross-sectional plan view of the safety slip mechanism of FIG. 33 through section C—C.

FIG. 1 shows a drilling rig generally designated at 100. The drilling rig 100 is particularly suited for use in the business of exploration, exploitation and production of hydrocarbons, but could also be used for the same purposes for other gases and fluids such as water. With regard to hydrocarbons, the drilling rig 100 can be used for operations such as, but not limited to, snubbing, side tracks, under balanced drilling, work overs and plug and abandonments. The drilling rig 100 can be utilised for land operations (as shown in FIG. 1) as well as in marine operations since it can be modified to be installed on an offshore drilling rig, a drill ship or other floating vessels.

The drilling rig 100 comprises a derrick 102 which extends vertically upwardly from a rig floor 8, where the rig floor 8 is carried by a suitable arrangement of supports 104 which are secured by appropriate means to the ground 1 or floating vessel top side 1.

As can be seen in FIGS. 1 to 4 and 6, the drilling rig 100 optionally includes a ramp 5 which extends downwardly at an angle from the rig floor 8. The ramp 5 can be used by personnel as an evacuation slide 5 if it is required that the personnel quickly evacuate the drilling rig 100. A drill pipe guide track 7*a*, 7*b* is located at each side of the slide 5 and which fully extends from the drill rig floor 8 to the ground 1. A drill pipe rack 6*a*, 6*b* is located at the outer side of each respective drill pipe guide track 7*a*, 7*b*, where the rack 6*a*, 6*b* is capable of holding a plurality of tubular drill pipe lengths, such as drill pipe 17. Each rack 6*a*, 6*b* comprises two or more kickover troughs (not shown) spaced along the length of the rack 6*a*, 6*b*, where the troughs can be operated to move lengths of drill pipe 17 from the rack 6*a*, 6*b* to the respective track 7*a*, 7*b* or vice versa as required, and do this by being angled either respectively inwardly or outwardly by approximately two or three degrees either way. A rope or counterbalance winch arrangement (not shown) is also provided for each pipe guide track 7, such that the rope/winch arrangement can be operated to pull pipes 17 from the lower end of the track 7*a*, 7*b* up to the drill rig floor 8. The rope/winch arrangement can also be operated to lower pipe 17 from the drill rig floor 8 to the lower end of the track 7*a*, 7*b*.

It should however be noted that the downwardly angled fire evacuation slide 5 is an optional feature of the drilling rig 100.

FIG. 1 also shows an arm runner 9*a*, 9*b* being moveably located on a respective derrick dolly track 4*a*, 4*b*. As shown in FIGS. 3*b*, 7*a* and 8*b* for example, each arm runner 9*a*, 9*b* is provided with a pair of articulated pipe arms 12 which are hingedly attached at one end to the respective arm runner 9*a*, 9*b* and are hingedly attached at the other end to a respective pipe handler fluid swivel 13*a*, 13*b*. This arrangement allows the fluid swivel 13*a*, 13*b* to be moved, by means of suitable motors (not shown), inwardly from the plane parallel to the longitudinal axis of the respective dolly track 4*a*, 4*b* to the plane parallel with the longitudinal axis of the borehole, such that the articulated pipe arms 12 act like a collapsible parallelogram. A respective goose neck pipe 18*a*, 18*b* is provided at the upper end of the respective fluid swivel 13*a*, 13*b* and is in sealed fluid communication with the internal bore of the respective fluid swivel 13*a*, 13*b*. A suitable pipe end coupling is provided at the lower end of each fluid swivel 13, where this pipe end coupling may suitably be a screw thread coupling for connection with the box end of a drill pipe 17. A wire pulley 10*a*, 10*b* is provided for each arm runner 9, and is secured at one end to the upper portion of the arm runner 9, where the other end of the wire pulley 10 is coupled to a suitable lifting/lowering mechanism, which may be a motor and reel arrangement, or may be a suitable counter weight arrangement, or may be a suitable counter balance winch hoisting (not shown).

Alternatively however, the dolly tracks 4A, 4B of the derrick 102 could be modified to be the same as the dolly tracks of a conventional rig in which there will be a block (not shown) and top drive (not shown), and in this case the arm runners 9A, 9B are also suitably modified such that they can be used in conventional dolly tracks of a conventional rig.

A method of operating the pipe handling mechanism, in accordance with an aspect of the present invention, will now be described. Drill pipe 17*a* is lifted up one of the guide tracks 7*a* as previously described, until the upper end of the drill pipe 17*a* is located in relatively close proximity to the pipe coupling provided on the first pipe handler swivel 13*a*. The box end of the drill pipe 17*a* is then coupled to the pipe end coupling of the fluid swivel 13*a*, such that the pipe handling mechanism is in the configuration shown in FIG. 2. The cable 10*a* lifting/lowering mechanism is then operated such that the arm runner 9*a*, and hence drill pipe 17*a* is lifted upwardly to the configuration shown in FIGS. 1, 3*a*, 3*b*, 4, 5, 7*a* and 7*b*, until the arm runner 9*a* and hence drill pipe 17*a* are in the configuration shown in FIGS. 8*a* and 8*b*. It should be noted that it is preferred that the drill pipe 17*a* is lifted upwardly at a downwardly projecting angle, and this provides the advantage that the lower end of the drill pipe 17*a* is kept well clear of the rig floor 8.

However, it should be noted that the other arm runner 9*b* and drill pipe 17*b* have already been moved in a similar manner, and the associated motor has been operated to move the drill pipe 17*b* such that the articulated pipe arms 12 have moved inward and the drill pipe 17*b* is co-axial with the borehole.

A make up/break out unit will now be described for making up the drill string, in accordance with the present invention.

A make up/break out unit in the form of a snubbing unit is generally designated at 20 and is shown in FIG. 17(*a*) as comprises a frame 106 which is made up of a work basket base 106*a*, support column spacers 106*b*, work basket support column 106*c*, and snubbing unit base 106*d*. An upper tong 108 and a lower tong 109 are mounted within a tong frame 110 which is further mounted within the work basket base 106*a* as can be seen in FIG. 17*a*, where the tong frame 110 can be seen in isolation in FIGS. 17*b* to 17*e*.

It should be noted that the upper tong 108 can be used to make up/break out work strings, casing and production tubulars as large as 8⅝ inches in diameter, although if modified in a suitable fashion, then it could be used for larger diameters if required.

The lower tong 109 is also known as a rotary back up 109, and is used to rotate the drill string 17 at speed and torque required for milling, side tracking and drilling. However, the lower tong 109 also acts as a back up to the upper tong 108 when making up or breaking out connections.

Another main component of the snubbing unit 20 is a rotary bearing assembly 112 which is coupled to the upper surface of a cylinder plate 116. The moveable bearing of the rotary bearing 112 is secured to a set of travelling slips 114 which are used to engage the drill pipe 17, and hence the rotary bearing assembly 112 allows the travelling slips 114 to rotate whilst the slips 114, as will subsequently be described, support the weight of the drill string to permit simultaneous vertical pipe manipulation and rotation of the work string. As will also be described, a hydraulic swivel or hydraulic bypass (not shown) is integrated into the rotary bearing assembly 112 and allows the slips 114 to be remotely operated at all times and eliminate the need to make/break hose connections.

Mounting the tong system above the snubbing unit 20 travelling slips 114 eliminates the need to swing tongs 108, 109 to engage and disengage the drill pipe 17 at every drill pipe joint connection by allowing the drill pipe 17 and drill pipe joints to pass through the tongs 108, 109 during tripping operations. The tongs 108, 109 and travelling slips 114 have a manually operated "large-bore" feature which allows their bore to be quickly increased to allow passage of downhole tools with diameters up to and over 11 inches. A remotely mounted control panel can be utilised to operate all tong 108, 109 functions at any jack position without placing personnel at dangerous positions, and this enhances safety and speeds tripping operations.

Additionally, this has the advantage that operators will be able to make up/break out connections while the drill pipe 17 is being moved by the snubbing unit 20. It should be noted that reactive make up/break out torques are transferred between the tongs 108, 109 via the frame 106 and a reaction column 118 (as shown in FIG. 17(*a*) and 14 (as shown in FIG. 4), which is coupled to the frame 106 by means of a roller joint 120. Hence, the snubbing unit 20 can move vertically upwardly or downwardly by means of the roller joint 120. Hydraulic jacking cylinders 122, of which there are preferably four, are arranged, and act, between the stationary snubbing unit base 106*d* and the moveable cylinder plate 116, and actuation of the hydraulic jacking cylinders 122 provides movement to the cylinder is plate 116 and hence snubbing unit 20.

FIG. 17*a* also shows the location of fixed/stationary slips 124 as being mounted to the upper section of the BOP stack 126, where the fixed slips 124 and BOP stack 126 are stationary with respect to the drill rig floor 8. Hence, the snubbing unit 20 is moveable by the hydraulic jacking cylinders 122 with respect to the fixed slips 124.

The active make up/break out torques are transferred between the upper tong 108 and lower rotary back up 109 by means of an integral reaction column in the form of a closed head tong leg assembly 113 and the substructure of the derrick 102. This allows the snubbing unit 20 to accept conventional hydraulic load cell and torque gauge assemblies and/or electronic load cells required for computerised tubular make up control.

Reactive drilling torques will be transferred back to the derrick 102 by means of the reaction column 118 (shown if FIG. 3(*b*) as being securely mounted to the derrick 102) and roller joint 120. Hence, this rigid mounting system allows high speed work string rotation during milling/drilling operations with a minimum of rotating components, these being the travelling slips 114 and a portion of the rotary bearing assembly 112, which reduces vibration and hazards associated with exposed rotating equipment.

The upper tong 108 will now be described in detail. The upper tong 108 provides means to make up and break out tubing, casing or drill pipe during tripping and snubbing operations, and is hydraulically powered. The upper tong 108 comprises three sliding jaws (not shown) which virtually encircle the drill pipe 17 to maximise torque while minimising marking and damage to the outer surface of the drill pipe 17. The upper tong 108 is provided with a cam operated jaw system (not shown) which can be opened to allow passage of work string tool joints as well as tubing and casing couplings. A range of jaw systems can be used for different dies such as dove tail strip dies which are used with drill pipe tool joints, and wrap around dies which are used with tubing or casing. The upper tong 108 can also be used for running CRA tubulars (such as 13% to 26% Cr tubulars) with grit faced dies. Additionally, non-marking aluminium dies can also be used with low friction jaws. Additionally, electronic turns encoder(s) and electronic load cell(s) can be provided to permit torque turn compatibility with electronic OCTG analysis systems, which can provide a record, such as a computer print out, of the quality of the make up between the respective end joints of two tubulars.

Additionally, it should be noted that the dies can be replaced whilst pipe passes through the upper tong 108. Also, the upper tong 108 can be manually operated such that the tong bore can be increased to allow passage of tools with diameters up to 11.06 inches. The upper tong 108 is powered by twin two speed hydraulic motors (not shown) which provide speeds and torque capable of spinning and making/breaking high torque connections. The upper tong 108 is provided with a hydraulic power supply which has a 35 gpm and 3000 psi output (62 hydraulic Horse Power) which produces 30,000 ft lbs at 9 rpm and high torque, low speed mode and 15,000 ft lbs at 18 rpm in low torque, high speed mode.

Alternatively, the hydraulic motors can provide 24 rpm maximum speed and low torque, high speed mode at 47.6 gpm which is the maximum allowable flow rate using a standard PVG 120 Danfoss™ valve package, although alternative valve systems can be used to provide even higher speeds at higher flow rates. The upper tong 108 can be used for tubulars with a range from 2 1/16 inches to 8 5/8 inches outside diameter with a range of jaws and dies being supplied as required to accommodate the varying diameters. The gripping range for jaws being supplied with dove tail dies is half an inch under the nominal size of the jaws, and the gripping range for jaws supplied with wrap around dies is that the wrap around dies are machined to match specific tubing, casing, tool joints, couplings or accessory diameters.

The lower tong or rotary back up 109 has two functions. During drilling operations, the rotary back up 109 generates the torque required for high speed milling and drilling. This torque is transferred to the outer diameter of the work or drill string 17 by means of three sliding jaws. During tripping operations, the jaws of the rotary back up 109 are activated to grip the pipe 17 and resist the torque generated by the upper tong 108 when making up or breaking out the tubular connections. However, the rotary back up 109 differs from the upper tong 108 in several aspects. Firstly, the rotary back up 109 has large turntable bearings (not shown) to support the ring gear (not shown) instead of a series of dumb bell roller assemblies (not shown) which are provided on the upper tong 108. Also, the body of the rotary back up 109 is sealed and filled with gear oil to protect the bearings in gear surfaces during extended periods of drilling. A hydraulically operated braking system (not shown) is also provided which allows controlled release of residual work string torque. However, the rotary back ups 109 drive train (not shown) is similar to the drive train (not shown) of the upper tong 108, but features different motor displacements and gear ratios. However, like the upper tong 108, the rotary back up 109 utilises three jaws which virtually encircle the pipe 17 to maximise torque whilst minimising marking and damage to the outer surface of the pipe 17. The cam operated jaw system (not shown) of the rotary back up 109 can be opened to allow passage of tubing and casing couplings, and the rotary back UP's 109 jaw systems (not shown) are interchangeable with those of the upper tong 108. Dovetail strip dies (not shown) can be provided for the rotary back up's 109 jaws for use with drill pipe tool joints and wrap around dies can be used for tubing or casing. Additionally, the dies can be replaced while the drill pipe 17 passes through the rotary back up 109, and the rotary back up 109 can be manually operated to increase it's bore to allow the passage of tools with diameters up to 11.06 inches. Twin two speed hydraulic motors (not shown) provides speeds for milling and drilling operations. A removable lower pipe guide plate assembly (not shown) is provided separately for each specific coupling diameter and assists pipe alignment during jacking operations.

The hydraulic power supply of the rotary back up 109 supplies 145 gpm and 2250 psi output (190 hydraulic horse power) and produces 7500 ft lbs at 80 rpm in high speed, low torque mode and 15000 ft lbs at 40 rpm in high torque, low speed mode.

The tubular capacity and the gripping range for the rotary back up 109 is the same as that for the upper tong 108.

Referring again to FIG. 17(*a*), the tong frame 110 is bolted to the travelling slips 114 via a lower tong frame 111, although it should be noted that some configurations may require a separate adapter plate (not shown). The upper tong 108 is suspended within the tong frame 111 by double acting spring assemblies located on legs 113 (see FIG. 17(*b*)) which extend upward from the rotary back up 109. The upper tong 108 can be pinned in one of two positions to facilitate make up of work string tool joints and connections using couplings. The spring assemblies (not shown) within legs 113 allow the upper tong 108 to float ±2.5 inches to accommodate thread lead during make up or break out. An open throat top guide plate 115 is fixed to the upper end of legs 113 and is fitted with lifting eyes 117 which enable handling of the tong frame 110. An optional remotely operated adjustable upper guide plate assembly can be provided to facilitate hands off stabbing of tubulars, and hence the remotely operated adjustable upper guide plate assembly acts as a hydraulic stabbing guide for the tubulars. The tong frame 110 is approximately 39 inches wide by 39 inches deep.

The rotary bearing assembly 112 allows the travelling slips 114 to rotate under load while the pipe 17 is being manipulated. The rotary bearing assembly 112 is attached to the upper end of the cylinder plate 116 of the snubbing unit 20 and features a flange (not shown) to accommodate the travelling slip's 114 mounting bolts (not shown). These loads are transferred into a large diameter turntable bearing system (not shown) which runs within a closed housing of the assembly 112 to guard against contamination. An integral hydraulic swivel system (not shown) allows continuous slip 114 operation without the need to connect or disconnect hoses. The swivel features a cooling system (not shown) to minimise heat build up in seals (not shown) while the rotary bearing assembly 112 is being used for extended drilling operations. Preliminary specifications for the rotary bearing assembly 112 are as follows.

| | |
|---|---|
| Compressive load rating | 460,000 pounds |
| Tense (snubbing) load rating | 170,000 pounds |
| Rotational speed limit (swivel seal rating) | 106 rpm |
| Maximum swivel pressures (static non-rotating conditions) (note pressure should be bled off swivel while rotating) | 1500 psi |
| Maximum swivel coolant pressure | 60 psi |
| Recommended swivel coolant supply flow rate | 5–10 gpm |

The swivel should be cooled by fresh water although glycerol based antifreeze or equivalent may be required in cold climates.

A remote control and instrumentation console may also be provided and which features direct acting hydraulic control valves (not shown) to provide control for the following:

i) Tong motor direction manual directional control which uses a Danfoss PGV 120™ load independent proportional hydraulic control valve assembly (not shown) for open loop power unit with a manual lever operated valve section to control the tong motor with flow rates to 47.6 gpm.

ii) Tong motor mode (high torque, low speed or low torque, high speed).

iii) Tong torque limiter (manual preset for automatic dumping, and an electronic solenoid can add computer dump control).

iv) Tong backing pin.

v) Hydraulic system pressure control.

vi) Rotary back up motor manual directional control which uses a hydraulic control valve assembly for open loop power unit with a manual lever operated valve section. One section controls the rotary back up 109 motors with flow rates to 145 gpm which is the maximum allowable flow rate for continuous operation in high speed mode. Infinitely variable rotational speed control may be achieved most efficiently through the use of variable displacement pump systems. Alternatively, the speed may be adjusted by throttling the direction of control valve or through the use of an adjustable flow control valve.

vii) Rotary back up 109 motor mode providing for high torque, low speed or low torque, high speed.

viii) Tong backing pin for the rotary back up 109.

ix) Braking system control.

x) Torque gauge (hydraulic style) with dampener valve.

xi) Hydraulic system pressure gauge.

Referring now back to FIG. 8*a*, a tripping operation into an already drilled borehole will now be described. By way of explanation, a tripping operation is performed to insert tools required in the borehole for a specific downhole operation.

With boreholes being many thousands of feet deep, the length of drill pipe 17 must be included in the drill string and inserted into the borehole as quickly as possible.

A make up/break out mechanism in accordance with the present invention will now be described.

FIG. 8*a* shows the upper end of drill pipe 17*c* projecting upwardly from the snubbing unit 20. At this point, the fixed slips 124, which are located within a fixed slip housing 3, are energised to firmly grip against the outer surface of the lower end of drill pipe 17*c*, such that the fixed slips 124 are holding the entire weight of the drill string. The four hydraulic jacking cylinders 122 are then actuated to raise the snubbing unit 20 upwards until it reaches the position shown in FIGS. 7*a* and 9*a*, such that the upper end of drill pipe 17*c* and lower end of drill pipe 17*b* are located within the snubbing unit 20. The travelling slips 114 are then energised to engage the outer surface of drill pipe 17*c* just below the upper end thereof. The jaws of the rotary back up 109 are then energised to engage the outer surface of drill pipe 17*c* immediately below the upper end thereof and the jaws of the upper tong 108 are energised to engage the outer surface of drill pipe 17*b* immediately above the lower end thereof. The fixed slips 124 are then released and the hydraulic jacking cylinders 122 are then actuated to move the snubbing unit 20 downwardly. Simultaneously, the upper tong 108 is operated to rotate drill pipe 17*b* relative to drill pipe 17*c* such that the two joints thereof are made up to the required torque level. Therefore, by the time snubbing unit 20 has reached the position shown in FIG. 10*a*, the joint between drill pipe 17*b* and 17*c* has been made up. The pipe handler fluid swivel 13*b* can then be disengaged from the upper end of drill pipe 17*b* and can be moved downwardly on the arm runner 9*b*, as shown in FIGS. 11*b* and 12*b* to pick up another pipe 17. The fixed slips 124 are then re-energised to engage the outer surface of drill pipe 17*b*, and when this has been done, the engagement between upper tong 108, rotary back up 109 and the respective drill pipe 17*b*, 17*c* can be released. The hydraulic jacking cylinders 122 are then actuated once more such that the snubbing unit 20 moves to the configuration shown in FIG. 13*a*. The travelling slips 114 are re-energised to grip the drill pipe 17 and the fixed slips 124 are released. The hydraulic jacking cylinders 122 are then actuated to move downwardly such that the snubbing unit 20 and travelling slips 114 stroke the drill string 17 into the borehole. A typical length of travel of the hydraulic jacking cylinders 122, and hence stroke of the drill string 17, is 13 feet. The snubbing unit 20 therefore moves from the configuration shown in FIG. 13*a* to the configuration shown in the FIG. 14*a* and 15*a*. Additionally, articulated pipe arms 12*a* have moved pipe 17*a* to be co-axial with the drill pipe 17*b*.

The fixed slips 124 are once again energised to engage the drill pipe 17*b* and the travelling slips 114 are released, such that the hydraulic jacking cylinders 122 move the snubbing unit 20 to the configuration shown in FIG. 16*a* so that the upper end and lower end of respective drill pipes 17*b* and 17*a* are located within the snubbing unit 20.

This process is repeated for as many drill pipe 17 sections as required in order to make up the desired length of drill string 17.

This process provides an extremely quick make up (or if operated in reverse, break out) for a tripping operation.

Normally, for tripping operations, rotation of the drill string is not required. However, for drilling operations, the drill string 17 is required to be rotated and also requires that circulation occurs through the bore of the drill string 17 down to the drill bit located at the bottom of the drill string 17. The drilling rig 100 is capable of imparting rotary movement to the drill string 17 without the requirement for a conventional rotary table or top drive, and can also provide continuous circulation through the bore of the drill string 17, as will now be described.

The travelling slips 114, as previously described, are used to lower the drill string 17 into, or raise the drill string 17 from, the borehole, and the control system for the hydraulic jacking cylinders can be operated such that the cylinders 122 can push the drill string 17 into the hole. For instance, the drilling operation may require that the drill string 17 is forced down into the hole by a certain percentage of weight of drill pipe 17, such as 10% weight. The rotary bearing assembly 112 and the travelling slips 114 can also be operated to impart rotation to the drill string 17, either as it is being inserted into, or pulled from the borehole, or even whilst the drill string 17 is vertically stationary.

Additionally, or alternatively to the rotary bearing assembly providing the power to rotate the drill string 17, the rotary backup 109 can be operated to impart rotation to the drill string 17.

A continuous circulation apparatus and method in accordance with the present invention will now be described, which is particularly for use during a milling/drilling operation.

FIGS. 18 to 23 show a portion of an apparatus 130 of the continuous circulation system, with FIGS. 24 to 28 showing flow diagrams for the operation thereof. FIG. 19 shows the continuous circulation apparatus 130 in isolation, and FIG. 18 shows the continuous circulation apparatus 130 incorporated in the snubbing unit 20. Referring firstly to FIG. 19, there is shown a first embodiment of apparatus 130 as comprising an upper seal 132 in the form of a shaffer sealing element 132, a lower seal in the form of a pair of rams 134*a*, 134*b* and a middle full bore valve 136 in the form of a 10,000 psi plate valve 136. Housing for these components is also provided in the form of a shaffer type bonnet 138, centre housing 140 and a main housing 142. The shaffer seal 132 is provided with a piston assembly 144 which can be moved upwardly to energise the shaffer seal 132 around the outer surface of a pipe 17 located in the bore of the shaffer seal 132 by the introduction of pressured hydraulic fluid into sealed closed port 146. The piston assembly 144 can be moved downwardly to release the sealing action of the shaffer seal 132 on the drill pipe 17 by introduction of hydraulic fluid into the seal open port 148.

It is important to note that the centre spindle 137 of the plate valve 136 is not located on the intended path of the longitudinal axis of the drill string 17. However, the main working plane of the plate valve 136 is perpendicular to the longitudinal axis of the intended path of travel of the drill string 17. A pair of circular apertures 150*a*, 150*b* are provided in the plate valve 136, and a pair of sealing rings 152*a*, 152*b* are provided on the upper surface of the plate valve 136, such that the centres of the apertures 150*a*, 150*b* and sealing rings 152*a*, 152*b* are located at the same radius from the centre spindle 137. Furthermore, the centres of the apertures 150*a*, 150*b* are located on the same diameter, and the centres of the sealing rings 152*a*, 152*b* are also located on the same diameter. The valve plate 136 is arranged such that, with the centre spindle 137 being off centre of the longitudinal axis of the drill string 17, the centre point of the apertures 150*a*, 150*b* and sealing rings 152*a*, 152*b* bisect the longitudinal axis of the drill string 17 as the valve plate 136 rotates. In other words, the centre spindle 137 is located off centre by a distance equal to the radius of the centre lines of the apertures 150 and sealing rings 152.

As shown most clearly in FIG. 20, a circulating port 154 is formed immediately vertically below the location of the plate valve 136 and immediately vertically above the pipe rams 134*a*, 134*b*.

The inner faces of the pipe rams 134*a*, 134*b* are formed such that when the rams 134 are brought together, they provide a sealing fit around the outer surface of the drill pipe 17.

The plate valve 136 is provided with a gearing surface 156, and an internal hydraulic motor 158 with an appropriately geared drive is also provided, such that actuation of the hydraulic motor 158 rotates the plate valve 136.

Optionally, but preferably, a further port 220 (as shown in FIG. 24) is provided into the inner chamber of the continuous circulation apparatus 130, where the further port 220 is located in between the shaffer sealing element 132 and the plate valve 136.

The further port 220 can be opened to purge air from the pipe joint 17B being introduced into the apparatus 130 prior to the plate valve 136 being opened; in this manner the shaffer seal 132 is first closed around the pipe joint 17B and the further port 220 is opened such that air may be flushed out or pumped out of the joint 17B.

Optionally, but preferably, a joint integrity checking apparatus is further provided for use with the continuous circulation apparatus 130; the joint integrity apparatus (not shown) provides an external pressure check on the integrity of the pipe joints that are made up within the continuous circulation apparatus 130. In order to utilise the joint integrity apparatus, the pipe joint to be checked is maintained within the middle of the continuous circulation apparatus 130, that is in the position shown in FIG. 25. The rams 134A, 134B are maintained in the closed configuration, such that they seal about the upper end of the lower pipe 17C. Then, either a fluid or more preferably a gas, such as nitrogen or most preferably helium, is introduced under pressure into the chamber (the portion intermediate the circulation port 154 and injection port 184) through either the circulating port 154 or the injection port 184 until the pressure of the fluid or gas reaches a relatively high fixed pressure. A pressure sensor (not shown), which is preferably a digital pressure sensor, is provided in either the circulating port 154 or the injection port 184 lines and the output of the pressure sensor is preferably coupled to a computer control system that is recording the whole activity of the rig 100; the computer control system typically being located in the rig cabin 31. The computer control system (not shown) monitors the output of the pressure sensor, such that if the output of the pressure sensor starts to fall then the integrity of the pipe joint between the lower pipe 17C and the upper pipe 17B is questionable. Such a questionable pipe joint connection could be due to a number of factors such as, but not limited to:

1) wear and tear of the joint;
2) contamination within the screw thread connections of the joint;
3) insufficient torque being applied to the joint; and/or
4) excessive jawing or washout passing through the joint on previous trips of the joint into a borehole.

A second embodiment of a continuous circulating apparatus 160 is shown in schematic form in FIG. 26 and comprises an upper seal 162, which may be in the form of a shaffer sealing element 162, similar to that shown in FIG. 19, a lower seal 164, again in the form of a shaffer sealing element and a plate valve 166, similar to that shown in FIG. 19. This embodiment is termed a stripper design 160. With regard to the stripper design 160, it should be noted that the upper seal may alternatively be a rubber pack off element 162 in the form of a rubber ring 162. This provides a friction seal with respect to the outside surface of the pipe 17 or pipe joint and does not require to be actuated. The inner diameter of the rubber ring 162 is slightly less than the outer diameter of the pipe 17, and the rubber ring 162 is elastic such that it can deform to allow the passage of joints therethrough. The lower seal element 164 of the stripper design may have a similar rubber ring 164.

A third embodiment of a continuous circulating apparatus 170 is shown in FIGS. 27 and 28 and comprises an upper seal 172 in the form of a pair of rams 172 similar to the rams 134 shown in FIG. 19, a lower seal 174 in the form of rams 174, similar to the rams 134 shown in FIG. 19, and a centre valve 176 in the form of a pair of full bore sealing rams 176. This third embodiment 170 is termed a ram design 170.

A method of operating the continuous circulating system will now be described.

For drilling operations, the lower end of a kelly hose 180 is attached to the upper end of the next drill pipe 17 to be made up into the drill string, with the upper end of the kelly hose 180 being coupled to the pipe handler fluid swivel 13. A drilling fluid supply conduit 182 is coupled to the outer end of the goose neck pipe 18. Referring to FIG. 9*a*, at this point in the circulation system cycle, no drilling fluid is circulated through the goose neck 18, and the relative locations of the lower drill pipe 17*c* and upper drill pipe 17*b* within the snubbing unit 20 is shown in schematic form in FIG. 24 at this point. Valve $V_3$, which is located between the kelly hose 180 and the fluid supply conduit 182, is shown as closed. At this point, middle full bore valve, in the form of plate valve 136 is shown as being closed, in that one of the sealing rings 152 is concentric with the longitudinal axis of the drill pipe 17*c*. Lower valve 134 is closed around the outer surface of the upper end of drill pipe 17*c*, and injection port 184 is closed by means of valve $V_2$. Valve $V_4$ is also closed and which is located between the kelly hose 180 and a bleed off line 186. Valves $V_5$ and $V_1$ are located between the circulating port 154 and the fluid supply conduit 182, and at this point, $V_5$ and $V_1$ are both open, and hence drilling fluid is being supplied through circulating port 154 and into the inner bore of the snubbing unit 20 and hence inner bore of the drill pipe 17*c*.

It should also be noted that the snubbing unit 20 is provided with another slip system 190, in the form of upper slips 190, and which will normally only be utilised during a continuous circulating operation. The upper slips 190 (not shown in FIG. 17(*a*) but shown in schematic form in FIGS. 24 and 25, and shown in a preferred form in FIGS. 29, 30 and 31) are mounted to the upper end of a feeder plate 192 of the snubbing unit 20 by means of an arrangement of hydraulic jacking cylinders 194, and in a preferred embodiment, there are four such hydraulic jacking cylinders 194. The upper slips 190 are operable to firmly grip the drill pipe 17*b* as it is being inserted into the snubbing unit 20, such that the upper slips 190 provide support to the drill pipe 17*b*, and the hydraulic jacking cylinders 194 are actuated to firmly lower or feed the drill pipe 17*b* into the snubbing unit 20.

The next stage of operation is shown in FIG. 25, and which shows that the middle plate valve 136 has been rotated such that an aperture 150 is co-axial with the longitudinal axis of the drill pipes 17. Simultaneously, the upper seal 132 is closed around the upper pipe 17*b*, and valve $V_3$ is opened. This flushes fluid into the drill pipe 17*b* and hence equalises the pressure above the plate valve 136 with the pressure below the plate valve 136, since valves $V_5$ and $V_1$ are still open.

The upper slips 190 remain actuated to firmly grip, and hence support, the drill pipe 17*b* against the force of the pressure which would otherwise force the drill pipe 17*b* upwards and out of the snubbing unit 20.

The plate valve 136 is then rotated to the position shown in FIG. 25 such that one of the apertures 150 is concentric with the longitudinal axis of the drill pipe 17. Valve $V_1$ is then closed.

Downward movement of the upper pipe 17*b* is again commenced as previously described (i.e. by a combination of downward movement of the wire pulley 10*b* and also downward movement of the hydraulic jacking cylinders 194) until it comes into close proximity with the upper end of lower pipe 17*c*. Valve $V_2$ is then opened and a suitable fluid is supplied into the injection port 184 via the now open $V_2$, in order to flush the threads of the two pipes. Hence, the upper tong 108 and the lower tong or rotary back up 109 are operated to grip the two pipes 17*b*, 17*c* and the actuation of the upper slips 190 upon the drill pipe 17*b* is released. Thereafter, the upper tong 108 and the lower tong/rotary back up 109 are operated to make up the two pipes 17*b*, 17*c*.

The drill string 17 continues its downward movement by operation of the hydraulic jacking cylinders 122, travelling slips 114 and fixed slips 124 until such a time that the upper end of the pipe 17*b* is at the thread engagement height; that is the location of pipe 17*c* as shown in FIG. 24. The kelly valve is then backed off the upper end of pipe 17*b* and is pulled upwardly by the counterbalance winch and/or the upper slips 190 and hydraulic jacking cylinders 194. It should be noted that upper seal 132 is still sealing around the kelly valve. Once the kelly valve has passed upwards through the aperture 150, the middle plate valve 136 is closed. Valve $V_4$ is then opened to bleed off pressure, and $V_3$ is closed and $V_5$ is opened. The upper seal element 132 can then be opened and the next pipe joint can be introduced into the snubbing unit 20. The method is repeated for as many joints as required, and hence continuous circulation of drilling fluid through the drill string is achieved.

FIGS. 29 to 31 show a preferred form of a slip mechanism 200; it should be noted that the slip mechanism 200 is preferably suitable for use as the fixed/stationary slips 124 and/or travelling slips 114 and/or upper slips 190.

The slip mechanism 200 can also be referred to as a snubbing slip mechanism 200. The slip mechanism 200 comprises a slip bowl 202 or slip housing 202 which is provided with at least one, and preferably four, hydraulic jacking cylinders 204 which extend vertically upwardly from the base of the slip housing 202. Four snubbing slips 206 are provided within the slip housing 202 where the width of each snubbing slip 206 circumscribes no greater than 90° of a circle. The innermost faces of each of the snubbing slips 206 have a common curvature such that when they are in the closed configuration as shown in FIG. 30, they 206 come together to form an inner bore and are provided with a suitably gripable surface such that they 206 are capable of securely gripping the outer surface of the drill pipe 17 and can thus support the weight of the drill string.

The inner surface of the slip housing 202 is tapered outwardly from the base of the slip housing 202 to the uppermost portion of the slip housing 202 and four longitudinally extending slots (not shown) are formed equidistantly around the inner surface of the slip housing 202. A longitudinally extending dovetail shaped key (not shown) is provided on the outer surface of each snubbing slip 206 such that the dovetail shaped key engages in the respective slot of the slip housing 202. The upper end of the hydraulic jacking cylinders 204 are suitably coupled to each snubbing slip 206 such that actuation of the hydraulic jacking cylinders 204 moves the cylinders 204 from their home (non-stroked) configuration shown in FIG. 30 to the fully stroked configuration shown in FIG. 29; in this manner the snubbing slips 206 can be moved from the closed (and pipe gripping) configuration shown in FIG. 30 to the open (and non-pipe gripping) configuration shown in FIG. 29.

It should be noted that conventionally, particularly when tubing such as casing and liner tubing (which has a flush outer surface along its length) is being passed through a set of slips, that a safety mechanism is used. This conventional safety mechanism comprises a manual clamp which is set around the outer surface of the tubing and which must be put on manually by an operator such as a roughneck. This manually applied clamp is arranged to act as a safety feature such that if the snubbing slips 206 lose their grip on the smooth outer surface of the casing/liner string then the manually applied clamp will collide against the upper surface of the snubbing slips, thus forcing them further down the tapered surface and thereby increasing the grip being applied by the snubbing slips to the outer surface of the casing. However, this conventional clamp arrangement is dangerous to apply and also time consuming.

In accordance with the present invention a safety slip 208 is mounted to the upper end of each snubbing slip 206 by means of a biasing mechanism such as a set of coiled springs 210; however, those skilled in the art will appreciate that a different type of biasing mechanism could be used, such as a leaf spring or rubber/neoprene element (not shown) or a lever arrangement as shown in the second embodiment of FIGS. 32 to 34. The coiled springs 210 are arranged to naturally bias the safety slips 208 away from the snubbing slips 206. When the snubbing slips 206 are in the closed configuration as shown in FIG. 30, they are gripping the casing string or drill string 17 and the safety slips 208 are also gripping the outer surface of the string since the rear end or outermost end of each safety slip 208 abuts against a safety slip stop 212 which is conveniently mounted in a suitable manner to the upper end of the snubbing slip 206.

Even more advantageously, the safety slip 208 is provided with a moveable safety slip front 214, where the safety slip front 214 is mounted to the safety slip back 208 by means of a dovetail shaped key (not shown) and slot (not shown) arrangement provided on a tapered surface, as shown in FIG. 31.

Accordingly, with the safety slip front 214 gripping the casing string, if the casing string begins to slip through the snubbing slips 206 when they are in the closed configuration, the safety slip front 214 and then the safety slip back 208 will travel downwardly with the casing string against the biasing action of the coiled springs 210 until the lower face of the front 214 and back 208 collide with the upper face of the snubbing slips 206 across the full cross-sectional area of the upper face of the snubbing slips 206 (which are greater in cross-sectional area than the lower face of the snubbing slips 206). Accordingly, the aforementioned collision causes the snubbing slips 206 to move downwardly to grip the tubing string even more. When the tubing string or drill string is ready to intentionally move through the slip mechanism 200, the cylinders 204 are actuated to stroke outwardly from the closed configuration of FIG. 30 to the open configuration of FIG. 29. In this manner, the snubbing slips 206 and safety slips 208, 214 are moved not only upwardly but outwardly away from the tubing/drill string 17, and the safety slips 208, 214 are moved upwardly away from the snubbing slip 206 by the biasing mechanism 210, such that they 208, 214 return to their 208, 214 starting (spaced) configuration.

Accordingly, the embodiment of the slip mechanism provides an automatic safety slip 208, 214 device that does not require manual intervention.

FIGS. 32, 33 and 34 show an alternative arrangement of the safety slips 208, 214 where the safety slips 208, 214 move in an arc via a hinge 218 and pivot 219 into engagement and out of engagement with the tubing string or drill string 17, rather than in the vertical movement shown in the embodiment of FIGS. 29 and 30, where the arc movement is shown in FIG. 33 by arrow 216. In addition, the hinge 218 that moves about the pivot 219, acts as a safety slip stop 218, 219.

The aforementioned apparatus provides distinct advantages over conventional work over and drilling units. For instance, it is capable of making or breaking connections while circulating and tripping pipe in or out of the well bore. Furthermore, it can replace a conventional rotary table and can be rigged up on almost any drilling rig, platform, drill ship or floater. For rig assist, the jacking slips are picked up like a joint of pipe and simply stabbed into the rotary table. The unit fits flush with the rig floor and allows for normal rig pipe handling to be used. In this scenario, there is minimal or no learning curve for the rig personnel to go through, and with there being no loose equipment above the rig floor 8 associated with this apparatus, the possibility of dropped objects has been eliminated.

The unique articulating pipe handling arms 12 and power tong 108, 109 make up provides the apparatus 100 with the ability to make tubular connections "on the fly" with a continual trip speed of over 60 joints per hour being possible.

The apparatus 100 can be broken down into readily liveable components. Furthermore, the continuous circulation feature allows an operator to make and break connections without stopping circulation of fluid through the drill string. It is envisaged that the system will minimise collapse of boreholes and differential sticking without surging the borehole formation.

Modifications and improvements can be made to the embodiments herein described without departing from the scope of the invention.

The invention claimed is:

1. A method of circulating fluid through a tubular string, the string comprising at least one tubular, the method comprising:

providing a first fluid conduit for supplying fluid to the bore of an upper tubular to be made up into or broken out from the tubular string;

inserting the lower end of the upper tubular into an upper port, where a valve mechanism denies the flow of fluid into the first fluid conduit;

gripping the upper tubular with an upper tong;

selectively rotating the upper tubular;

providing a second fluid conduit for supplying fluid to the bore of the tubular string;

gripping the tubular string with a lower gripping device; and selectively rotating the tubular string with the lower gripping device.

2. The method according to claim 1 comprising the further including operating the valve mechanism to permit the flow of fluid into the first fluid conduit and upper end of the tubular.

3. An apparatus for circulating fluid through a tubular string, the apparatus comprising:

a first fluid conduit for supplying fluid to the bore of an upper tubular to be made up into or broken out from the tubular string;

a second fluid conduit for supplying fluid to the bore of the tubular string;

a first gripping device for gripping the upper tubular, the first gripping device capable of providing rotation to the upper tubular;

a second gripping device for gripping the tubular string as the first gripping device provides rotation to the upper tubular; and a tubular movement assembly capable of moving the tubular string relative to the first gripping device and the second gripping device, wherein the tubular movement assembly comprises a third gripping device, a fourth gripping device and a motive member for moving the third gripping device relative to the fourth gripping device.

4. The apparatus of claim 3, wherein the motive member is a fluid cylinder.

5. The apparatus of claim 3, wherein the third gripping device is capable of rotating with the tubular string.

6. The apparatus of claim 3, wherein the third gripping device is capable of being remotely operated.

7. An apparatus for providing a continuous circulation through a tubular string, comprising:

a chamber having a rotatable plate valve disposed therein, the rotatable plate valve providing a selective communication pathway between an upper portion and a lower portion of the chamber;

a first fluid conduit for supplying fluid to a tubular to be made up into or broken out from the tubular string, the first fluid conduit in fluid communication with the upper portion;

a second fluid conduit in fluid communication with the lower portion for supplying fluid to the tubular string;

an upper tong having a gripping device for gripping the tubular, the upper tong further comprising a rotation mechanism to provide rotation to the gripping device to provide rotation to the tubular; and a lower gripping device for gripping the tubular string.

8. The apparatus of claim 7, wherein a center of the rotatable plate valve is misaligned with a center of the tubing string.

* * * * *